US005707287A

United States Patent [19]

McCrea, Jr.

[11] Patent Number: 5,707,287

[45] Date of Patent: Jan. 13, 1998

[54] JACKPOT SYSTEM FOR LIVE CARD GAMES BASED UPON GAME PLAY WAGERING AND METHOD THEREFORE

[76] Inventor: Charles H. McCrea, Jr., 2816 La-Casita, Las Vegas, Nev. 89120

[21] Appl. No.: 602,074

[22] Filed: Feb. 15, 1996

Related U.S. Application Data

[63] Continuation-in-part of Ser. No. 420,303, Apr. 11, 1995, Pat. No. 5,605,334.

[51] Int. Cl.[6] ..... A63F 1/00

[52] U.S. Cl. ..... 463/27; 273/292

[58] Field of Search ..... 463/27; 273/292

[56] References Cited

U.S. PATENT DOCUMENTS

| | | | |
|---|---|---|---|
| 4,339,798 | 7/1982 | Hedges et al. | 463/26 |
| 4,836,553 | 6/1989 | Suttle et al. | 273/292 |
| 4,861,041 | 8/1989 | Jones et al. | 273/292 |
| 5,078,405 | 1/1992 | Jones et al. | 273/309 |
| 5,288,077 | 2/1994 | Jones | 273/292 |
| 5,356,145 | 10/1994 | Verschoor | 273/149 R |
| 5,374,061 | 12/1994 | Albrecht | 273/149 R |
| 5,393,067 | 2/1995 | Paulsen et al. | 273/292 |
| 5,472,194 | 12/1995 | Breeding et al. | 463/27 |

FOREIGN PATENT DOCUMENTS 44395027 9/1994 Germany .

OTHER PUBLICATIONS

Safe Jack—Viktor Mayer & Michael Order, Jan. 24, 1995.

Scarne's New Complete Guide to Gambling, John Scarne, 1974, Simon & Schuster, pp. 382–388.

*Primary Examiner*—William H. Grieb

*Attorney, Agent, or Firm*—Dorr, Carson, Sloan & Birney, P.C.

[57] ABSTRACT

A game table system, adapted for multiple sites under a central control, for providing a progressive jackpot in a live card game played at each gaming table between a dealer and a player. Each gaming table has an ante bet region, a dealer card region, and a player card region. The game table system of the present invention includes a sensor located at each bet region for detecting the value of the ante placed by the player at that location, a reader identifying each card dealt during the play of the game to the player and to the dealer, a computer connected to the sensor and the reader and the progressive jackpot for adding a predetermined percentage of the value of the ante to the progressive jackpot when a predetermined game event (such as the dealer going bust during the game of blackjack) occurs while preserving the value of the ante during the conventional play of the game. The computer, under the teachings of the present invention, awards the progressive jackpot to the player with a winning sequence of cards during the play of the game. The play, however, continues with the other players.

37 Claims, 13 Drawing Sheets

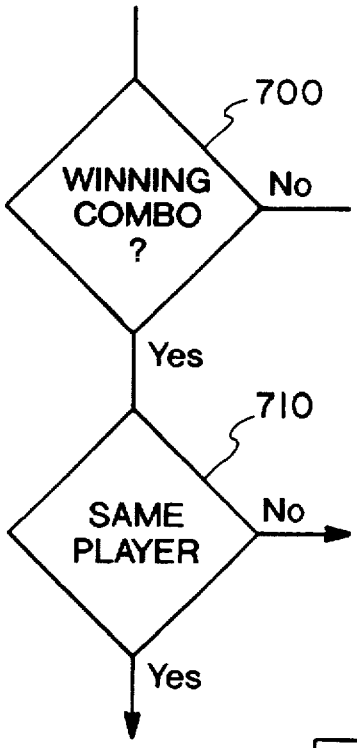
Fig. 7
Fig. 8
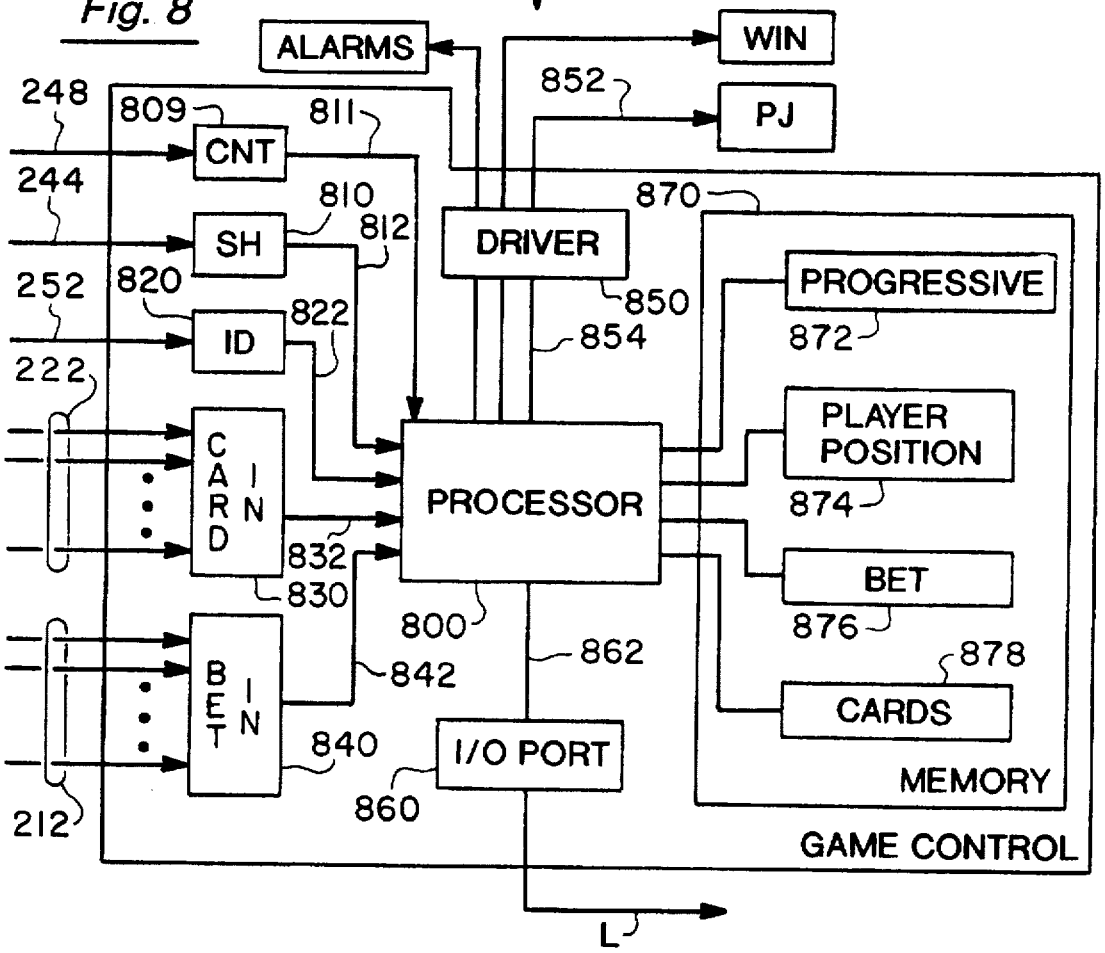

Fig. 12
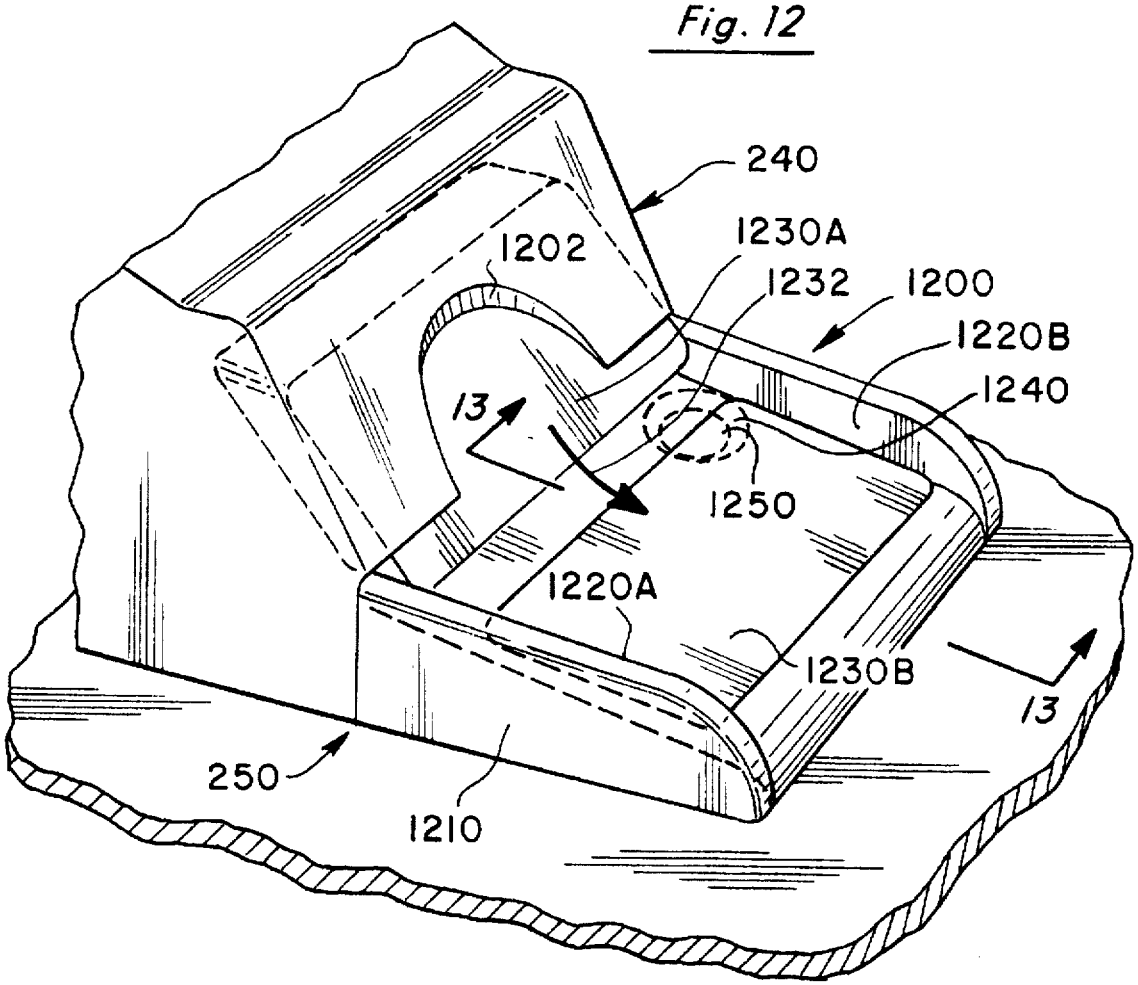
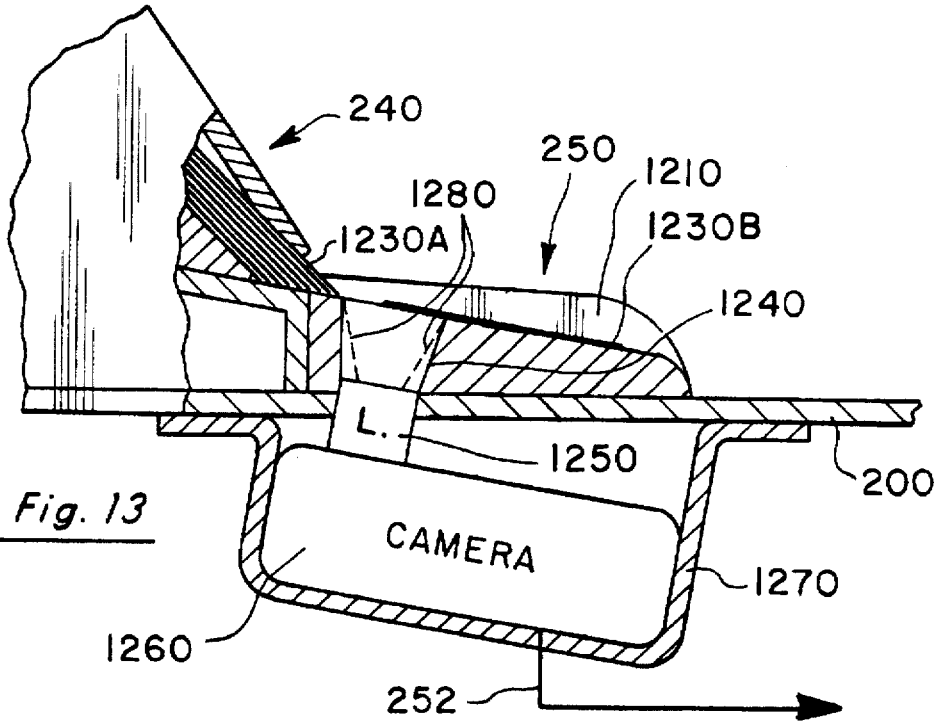
Fig. 13

Fig. 14
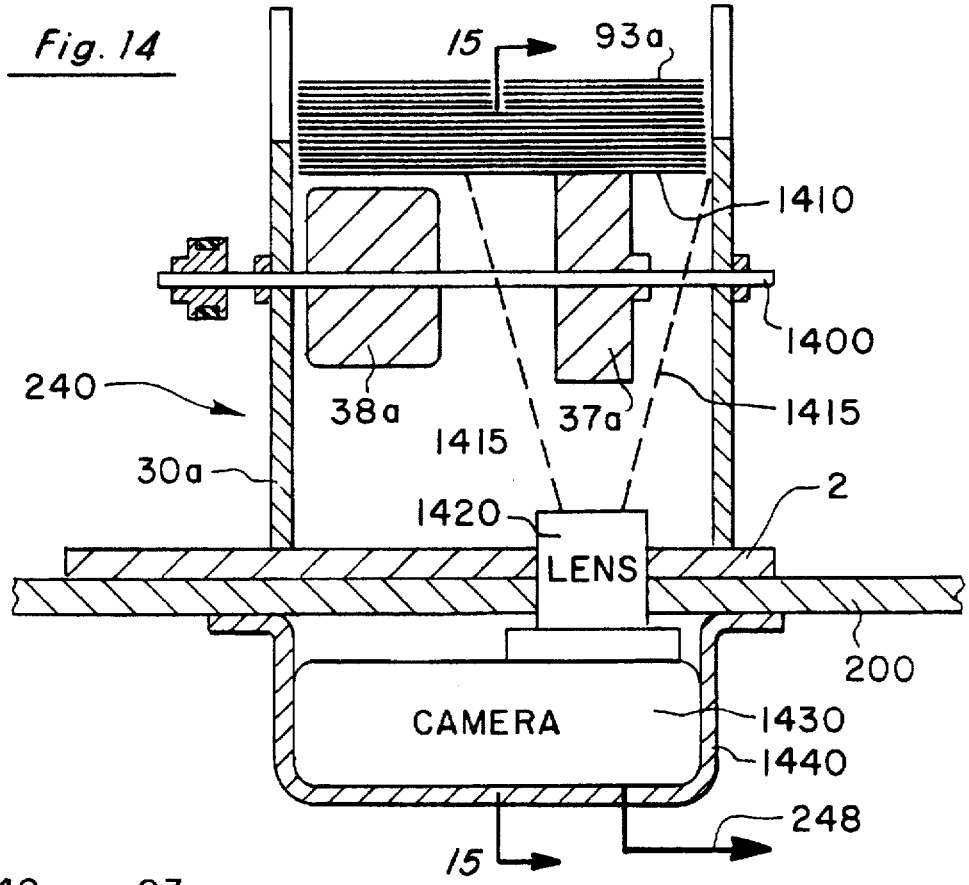
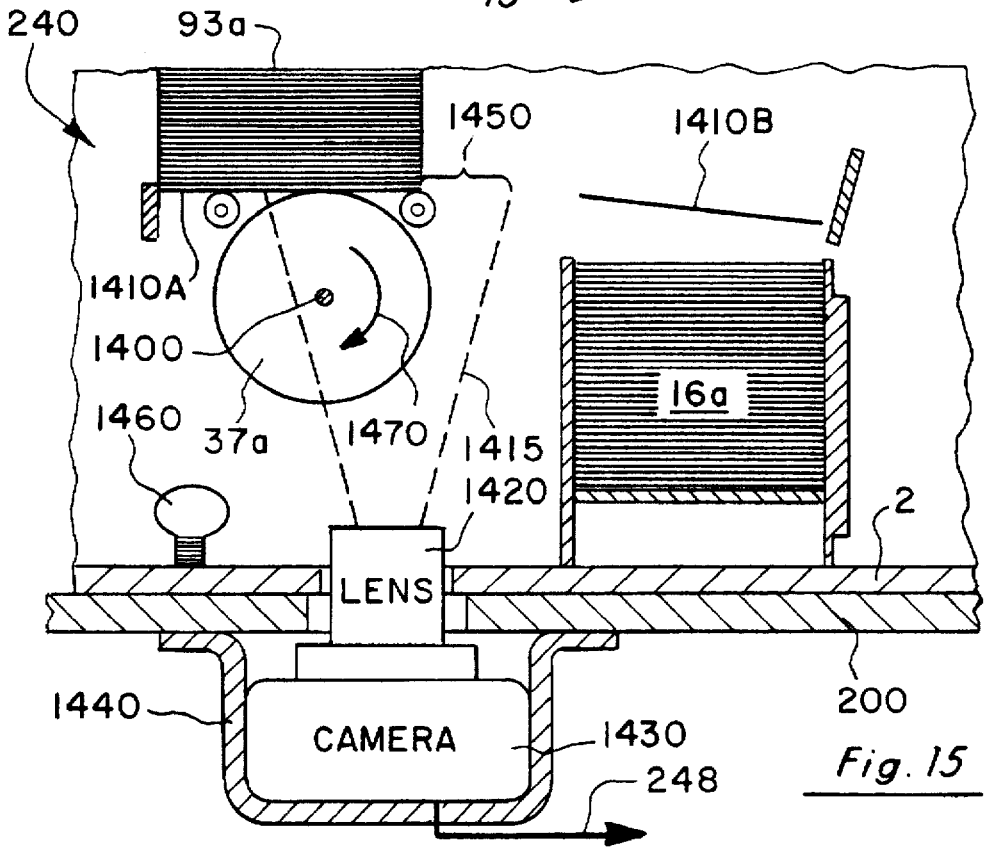
Fig. 15

240
1230A
1606
1602
1230B
250
1630
1670
1632
1600
1634
1636
16a
1410b
1660
1604
93a
37a
1640
1644
1642

1632
1670
1634
1672
1652
1610
1620
1636
LENS
CAMERA
1646
1644
1662
1642
1660

JACKPOT SYSTEM FOR LIVE CARD GAMES BASED UPON GAME PLAY WAGERING AND METHOD THEREFORE

RELATED INVENTION

This application claims the benefit of and is a continuation-in-part application of "Secure Multi-site Progressive Jackpot System for Live Card Games" filed Apr. 11, 1995, Ser. No. 08/420,303, by Charles H. McCrea, Jr. U.S. Pat. No. 5,605,334.

BACKGROUND OF THE INVENTION

FIELD OF THE INVENTION

The present invention relates to live card games and, more particularly, to providing progressive and game jackpots for live card games.

STATEMENT OF THE PROBLEM

Progressive jackpot slot machines and live card games (such as Blackjack, Baccarat, Chemin de Fer, Pal Gow Poker, Draw Poker, Stud Poker, and Lo-Ball Poker) represent two types of games that are popular among gamblers throughout the world. A need exists for a progressive jackpot system for live card games that permits progressive jackpot awards while minimizing interference with the conventional play of the game. A need also exists to provide game or table jackpots either in combination with the progressive jackpot or independent thereof.

A "hand" is commonly defined as one deal of cards to the players in a live card game. A "deck" for a particular live card game has a predetermined number of cards. For example, blackjack may use several conventional card decks with each card deck having four "suits" (diamonds, hearts, clubs, and spades) containing 13 cards of different "value" (ace through king) for a predetermined number of 52 cards.

In U.S. Pat. No. 4,836,553 entitled "Poker Game", a live card game is disclosed having a "progressive jackpot" feature. A player optionally participates in this feature by making "an additional jackpot wager" that is added to the jackpot wagers that are made by other players in that game or previous games. U.S. Pat. No. 4,861,041 is related to the aforesaid patent and provides structural detail incorporating the progressive jackpot element into blackjack. At the beginning of each hand, in addition to making the usual ante wager for blackjack, the player may also make an additional wager to be eligible to participate in the progressive jackpot component of the game during that hand. The '041 patent provides a separate coin acceptor at each player's playing location that receives the progressive bet. The coin acceptor sends an electronic signal to a main control board that then processes the progressive bet and increases the progressive jackpot meter by a predetermined amount. A dealer lock-out switch is provided that deactivates each coin acceptor so as to prevent late progressive wagering after the cards are dealt. The '041 patent requires a coin acceptor and coin acceptor circuitry as well as associated processor and programming.

U.S. Pat. No. 5,078,405 pertains to an apparatus for providing a progressive jackpot for live card games. The '405 patent allows each player to bet an additional "progressive" wager at the beginning of each hand by providing an apparatus to receive the progressive game token and to control a jackpot meter. The apparatus is built into the game table and any number of tables can be interconnected together to a single progressive jackpot meter.

U.S. Pat. No. 5,288,077 sets forth a method for progressive live card games that also requires a game play wager and a separate progressive play wager. In the '077 patent the sequence of cards for winning the progressive jackpot is chosen so as not to interfere with the play of the game.

U.S. Pat. No. 5,374,061 pertains to a card-dispensing shoe having a device that reads cards as they are dealt in a hand from the shoe. By using specially coded cards, indicating the value, the suit, and the deck identity of each card, this device enables the operator to read the cards being dealt.

U.S. Pat. No. 5,393,067 sets forth a system incorporating a progressive component into a live game card table. The '067 patent sets forth the provision of a separate coin acceptor assigned to each player position on the table for determining the presence of a coin to generate a signal indicating that a jackpot side bet has been placed. The coin acceptors have a low profile above the table so as to facilitate insertion and withdrawal of coins from them. A computer is used to keep track of the separate side jackpot bets.

U.S. Pat. No. 4,339,798 sets forth a remote gaming system wherein players located at remote positions are able to play a live game such as a live card game.

Pending German patent application No. P44 39 502.7 sets forth a computerized device that reads cards as they are dealt from a shoe and also senses when a hand is receiving cards at a position on a game table. The computer tracks each hand and records the value and suit of each card in each player's hand. The computer senses when a dealer has a blackjack and immediately issues a signal. This approach electronically surveys each game and minimizes manual inspection of the game. These computers can be linked by various means to a central computer so that numerous hands played at numerous remote locations can be exactly monitored.

A common characteristic of all of the above approaches, including conventional progressive systems for live card games, is the requirement that each player make a decision at the beginning of the hand whether or not to participate in the progressive feature of the game. To accommodate the player who wishes to place a separate progressive wager, separate slots or coin acceptors are provided in the game play area to receive the player's bet and separate lock out devices may be provided to prevent other players from placing late progressive bets. Hence, at a conventional live card game having a progressive feature, some players may place separate progressive bets and some players may not. In any event, the manufacturer of the game table must provide separate progressive slots or coin acceptors for each player's position. Whether or not a player participates in the progressive feature is entirely controlled by the player, and contributions are only made to the progressive jackpot when a player makes a separate progressive bet. The contribution is, therefore, "player controlled," and if the player does not win in the progressive feature, the progressive bet is lost.

A need exists to provide a jackpot feature (whether progressive, game, or a combination of both) to a live card game that minimizes interference during conventional play of the live card game. A need exists to eliminate the requirement that a player must place the separate progressive bet in separately provided for coin acceptors or slots. A need exists to have a player place only a conventional game wager to play the conventional live card game and to also qualify for the progressive feature automatically. A further need exists to provide a new level of excitement in live card games having progressive features by having the contribution to the progressive jackpot be made when a predetermined game event occurs during the conventional play of the live card game. A final need exists for a player to play a live card game wherein the initial game wager or bet is never affected by the progressive element feature so that whether or not the original game wager is lost is dependent on the play of the conventional game and not on the progressive feature as found in prior approaches.

SOLUTION TO THE PROBLEM

The present invention provides a solution to the above needs by providing a live card game table system that may be connected in a multi-site environment to a central control. The system identifies each card dealt by a dealer and stores the value and suit in memory; identifies which player positions have game bets in place; determines when a card is received at a player position; and ascertains whether the player position that has received a card has placed a game bet. The shuffler and shoe of the present invention read cards leaving the shoe. The present invention records the value and suit for each card received at each player position having a game bet placed.

Unlike the common characteristic discussed above for conventional progressive systems for live card games, the present invention does not require a player to place a separate progressive bet, and therefore, all separate hardware including separate progressive slots for coin acceptors and any and all lock-out devices are completely eliminated. Unlike the "player controlled" characteristic of the prior art, the present invention includes all players in the progressive feature without the requirement that a player place a separate "progressive bet." Rather, placing the game wager bet (which value typically varies from player to player) qualifies the player to participate in the progressive feature. The contribution (based on the value of the game wager) is not "player controlled" but is "game event controlled" under the teachings of the present invention. This adds a new level of excitement in live card games since all players know that a contribution of their game wager is being made to the progressive jackpot.

For example, in the game of blackjack, the game event could be when the dealer goes "bust" (i.e., his cards total over 21). When that game event occurs, a percentage contribution of the value of each player's game bet is made to the progressive jackpot. Another example would be to take a percentage of a specific portion of a bet as a contribution to the progressive jackpot. Thus, the operator of the game might establish that 50% of the sixth dollar wagered by a player would be contributed to the progressive jackpot. The operator could also specify that players wagering under $6 on any given hand could not qualify to win the progressive jackpot. Players wagering $6 and over would all contribute 50¢ to the jackpot regardless of the total amount wagered. Under the teaching of the present invention, the contribution is transparent to the players since it is not based on a separate progressive bet made by the player and the player does not jeopardize any portion of his or her game wager while playing the live card game. Hence, the player under the teachings of the present invention automatically participates in the progressive wager without the requirement of betting a separate wager. The player plays a conventional live card game with the progressive feature substantially transparent to the play of the game so as to minimize any interference with the play of the game. All separate coin slots or coin acceptors are eliminated for this progressive feature.

Furthermore, the game wager made by the player is conventionally played, but has the added benefit of qualifying the player for a progressive win when the player receives a winning combination of cards in a conventional fashion. Under the teachings of the present invention, all players who place a game wager automatically participate in the progressive feature. The contribution to the progressive jackpot is "game event controlled" and is not under the control of a separate progressive wager made by specific players.

Finally, the detection of winning sequences of cards could result in a progressive jackpot award, a game jackpot award, or a combination of both types of awards.

SUMMARY OF THE INVENTION

A gaming table system, adapted for multiple sites under a central control, is disclosed for providing a progressive jackpot in a live card game played at each gaming table between a dealer and a player. Each gaming table has a game bet region, a dealer card region, and a player card region. The gaming table system of the present invention includes a sensor located at each game bet region for detecting the value of the game wager placed by the player at that location, a reader identifying each card dealt during the play of the game to the player and to the dealer, and a computer connected to the sensor, the reader, and the progressive jackpot for adding a predetermined percentage of the value of the game wager to the progressive jackpot when a predetermined game event (such as the dealer going bust during the game of blackjack or a player wagering $6 or more) occurs, while preserving the value of the game wager during the conventional play of the game. The computer, under the teachings of the present invention, awards the progressive jackpot to the qualifying player with a winning sequence of cards during the play of the game. The play, however, continues with the other players. The detection of winning sequences of cards may also result in the award of game jackpots either individually or in combination with progressive jackpot awards.

According to the method of the present invention, a progressive jackpot is provided in a live card game played on a gaming table between a dealer and a player. The method includes the following steps. The player places a game wager in the bet region on the gaming table to play both the live card game and the progressive jackpot. The value of the game wager bet is automatically sensed by a sensor near the bet region. The hands of cards are then dealt by the dealer to the player and to the dealer and the hands are played in the live card game. Each card as it is dealt is automatically identified and stored so that each hand of each player and of the dealer is known. The system automatically adds a predetermined percentage value of the ante wager (or the wagers placed throughout the game) to the progressive jackpot when a predetermined game event occurs in response to the step of identification while preserving the value of the ante wager during the play of the game. The progressive jackpot is automatically awarded to the qualifying player having a winning sequence of cards.

BRIEF DESCRIPTION OF THE DRAWING

FIG. 7 is a flow chart setting forth the operation of determining a progressive jackpot winner, FIG. 8 is a block diagram setting forth the components of the game control, FIG. 13 is a side view of the addition of FIG. 12, FIG. 14 sets forth the addition of an optical reader for reading cards inserted into the automatic shuffler of FIG. 12, FIG. 15 is a side view of the addition of FIG. 14.

DETAILED DESCRIPTION OF THE INVENTION

1. Overview

Figure 1:
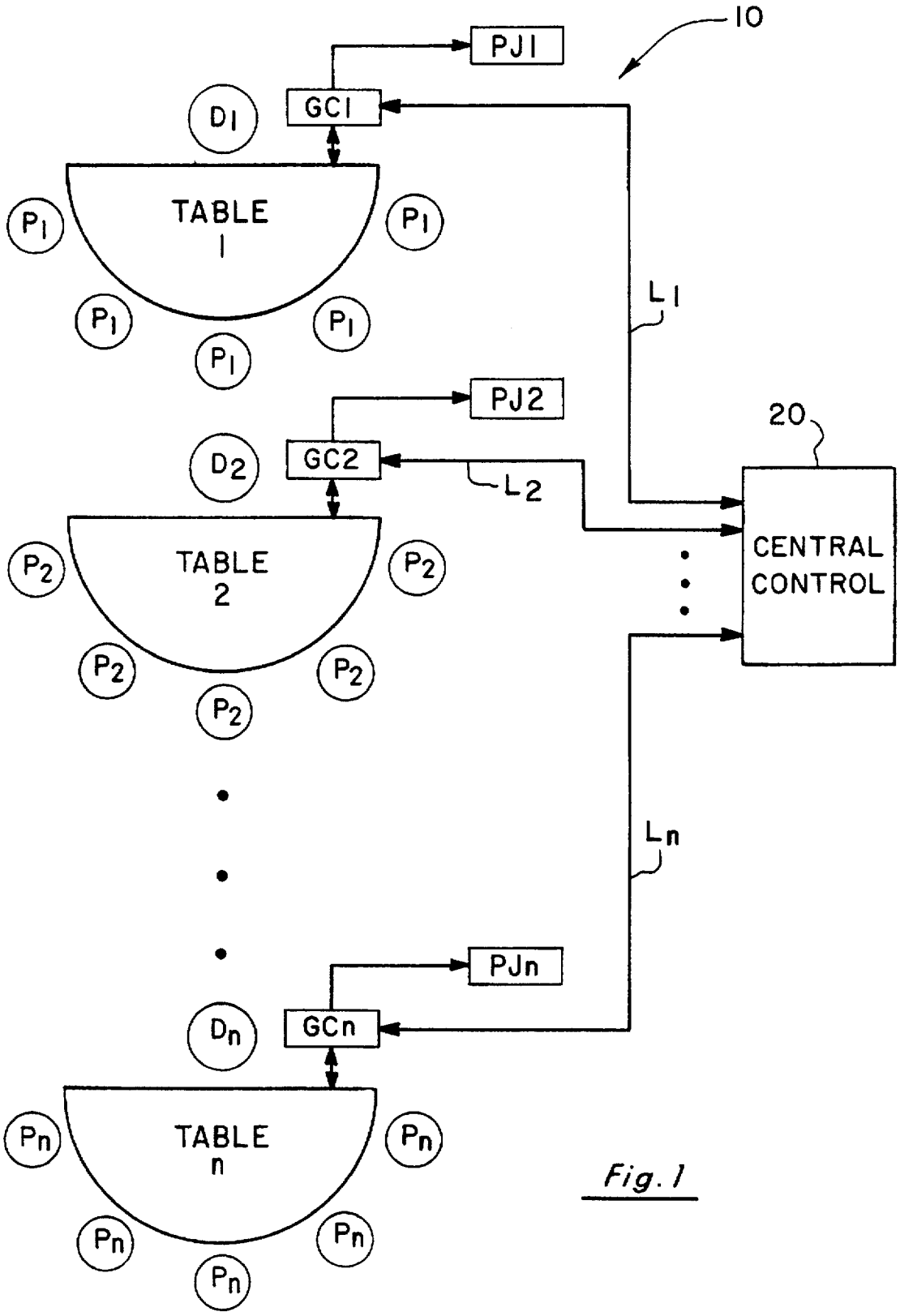
FIG. 1 sets forth a block diagram of the major components of the multi-site single wager progressive jackpot system of the present invention, FIG. 2 sets forth the details of an individual gaming table of the present invention, FIG. 3 sets forth an example of a card carrying a code, FIG. 4 sets forth the card and betting areas of the system of the present invention, FIG. 5 (Prior Art) illustrates a coin acceptor and coin-in light, FIG. 6(*a*), 6(*b*), 6(*c*) is a flow chart setting forth the operation of the present invention.

In FIG. 1, the single wager progressive jackpot system 10 of the present invention is set forth.

FIG. 1 shows a plurality of live card gaming tables (Tables 1 to n). These tables can be at different remote sites, or a group of tables can be clustered at one site, and a group of tables can be clustered at a second site, etc. Indeed, each table could be located at the same site such as a single casino. For example, twenty gaming tables could be located on a floor of a single casino or twenty gaming tables could be located at twenty different locations in the same casino, or twenty gaming tables could be located with each table in a different casino.

The progressive jackpot system 10 of the present invention includes a central control 20 interconnected to the plurality of gaming tables (Tables 1 to n). At each gaming table is a game control GC (GC1 to GCn) that communicates to the central control 20 over a communications link L. The communications link L can be hard wired, a network connection, a telephone line, or any combination thereof or other equivalent communications channel. The type of communication link L is not material to the teachings of the present invention.

At each gaming table is a progressive jackpot display PJ. As live card games are played at each table, each game control GC at each table delivers information over link L to the central control 20, which continually evaluates all live card game information and provides display information back to each game control GC to activate the current displayed value of the progressive jackpot in each progressive jackpot display (PJ1 to PJn).

At each table is a dealer D and a number of players P. Hence, in the system of FIG. 1, live card games (such as blackjack) may occur at each table. At each table one or a plurality of players P may be playing a card game with a dealer D. The game control GC at each table monitors the progress of each live card game including the wager information and delivers that information over the communications link L to the central control 20. The central control 20 updates the progressive jackpot information and continuously displays new values in the progressive jackpot displays (PJ1 to PJn).

The system 10 of the present invention is not limited to a particular type of live card game, to a particular number of tables, or to a particular number of players. When a player at one of the tables has placed a game bet and is dealt a predetermined winning combination of cards (e.g., four aces), the player wins the presently displayed jackpot value, and the central control 20 is informed by the game control GC at that table over link L and proceeds to update all other game controls and displays at the other tables so that all players and dealers know that a win occurred. The player is not required to place a separate progressive play bet as required in prior art systems.

2. Details of a Gaming Table

Figure 2:
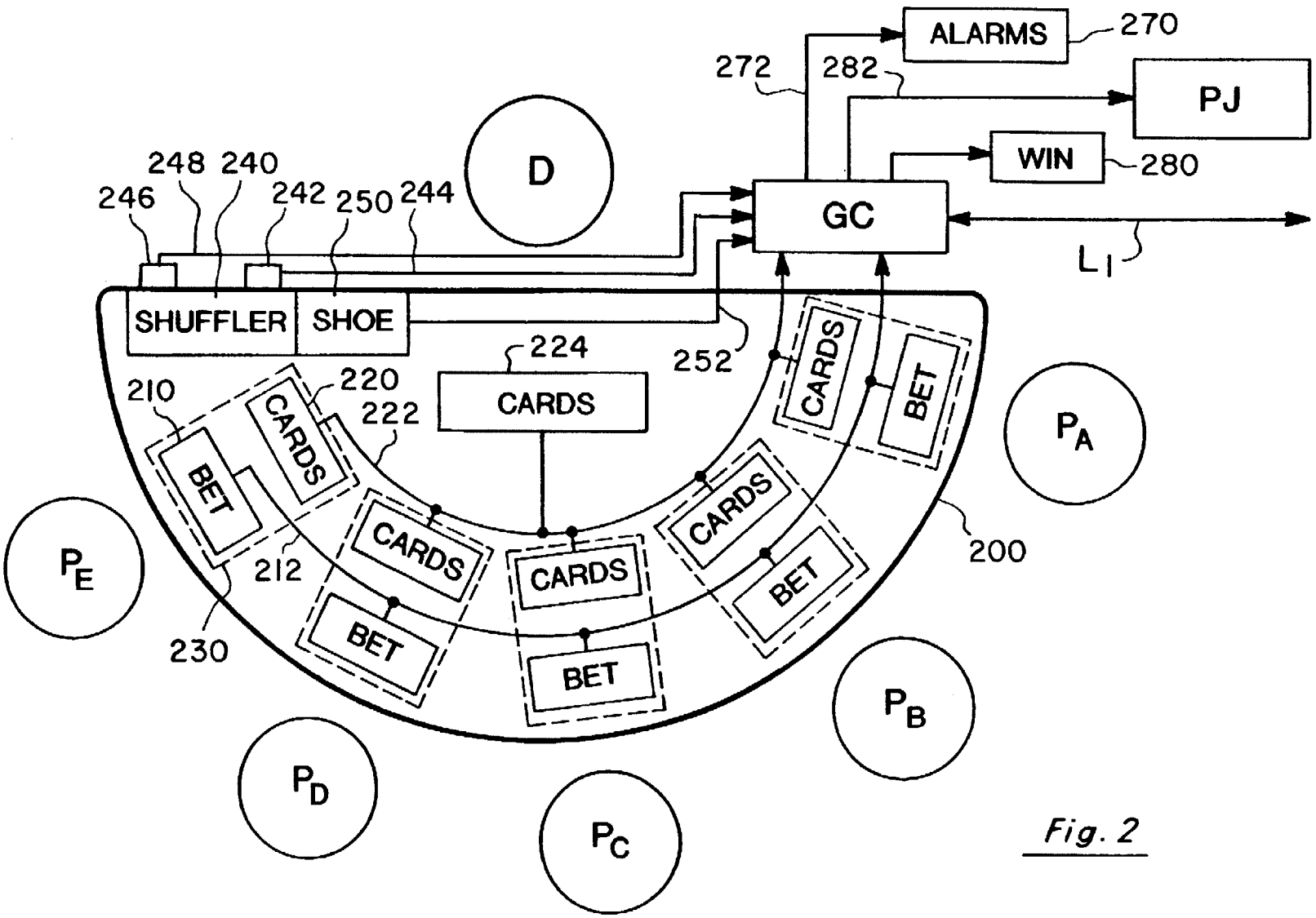

In FIG. 2, an individual gaming table 200 is shown having player positions $P_A$ to $P_E$. It is to be understood that any number of player positions could be provided.

As set forth in FIG. 1, each gaming table 200 has a game control GC interconnected to a progressive jackpot display PJ for displaying the current progressive jackpot.

The game control GC may have conventional inputs, outputs, and display (not shown). For example, a dealer could input his name and other information upon arriving at a gaming table 200. The display PJ can display a plurality of progressive jackpots based on different winning card combinations. The display PJ can also display the names of winners and the payout from other tables in the system. This type of feedback adds excitement to the progressive live card game and encourages players to place bets while playing a live card game. The game control GC also issues alarm 270 and win signals 280 which may constitute audible and/or visual signals to the players P, dealer D, or others (such as a pit boss). These signals may also be delivered over link $L_1$ to the central control 20.

At each player position P is a betting area 210 and a card-receiving area 220. The dealer D also has a card-receiving area 224. Each betting area 210 is interconnected over lines 212 to the game control GC. In the preferred embodiment, each betting area 210 is individually interconnected over lines 212 to the game control GC. It is to be understood that lines 212 could be a bus and that the game control GC could sequentially interrogate each betting area 210.

Likewise each card-receiving area 220 and 224, in the preferred embodiment, is interconnected over lines 222 with the game control GC. Rather than having individual lines 222, each card area 220 and 224 could also be interconnected to a single bus. As shown in FIG. 2, each betting area 210 and each card area 220 is positioned in a location near the playing position 230 of each player P.

Also located on gaming table 200, in the preferred embodiment, is an automatic card shuffler 240. This card shuffler 240 may be of the type, but not limited to, conventionally taught in U.S. Pat. No. 5,356,145, and as modified herein. Card shuffler 240 is designed to shuffle one or a plurality of decks after each hand so that when a hand is played, the discarded cards are inserted back into the shuffler 240 and reshuffled. This technique substantially minimizes, if not eliminates, card counting, thereby adding a high degree of security to the game. Under one embodiment of the present invention, a sensor 242 could be connected to the shuffler 240 to detect each time the shuffler 240 is activated to shuffle. The sensor 242 is connected over line 244 to the game control GC. The system 10, however, does not require an automatic shuffler and is operational with conventional live shuffling by the dealer.

Figure 3:
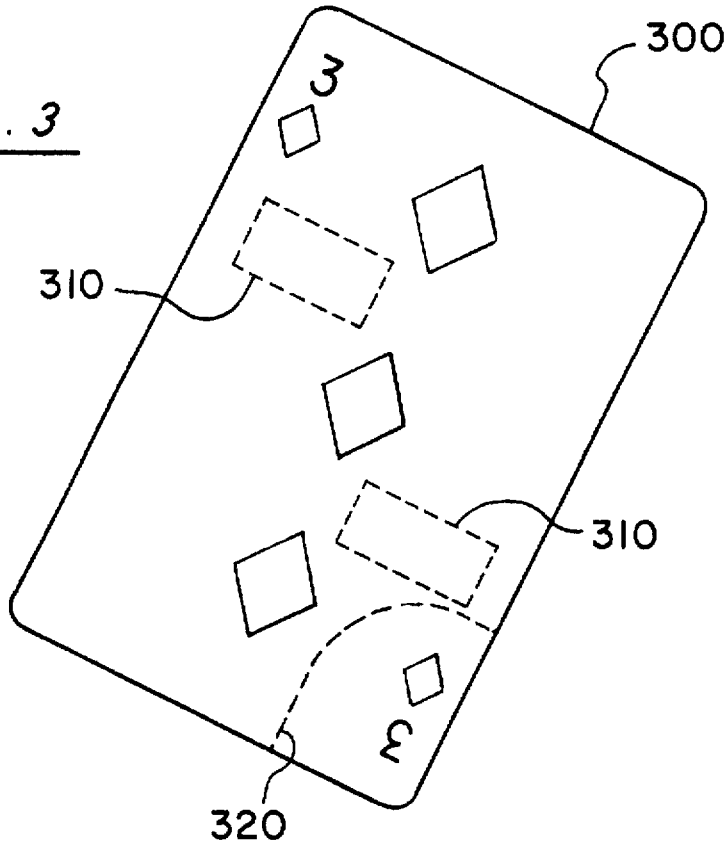
Figure 5:
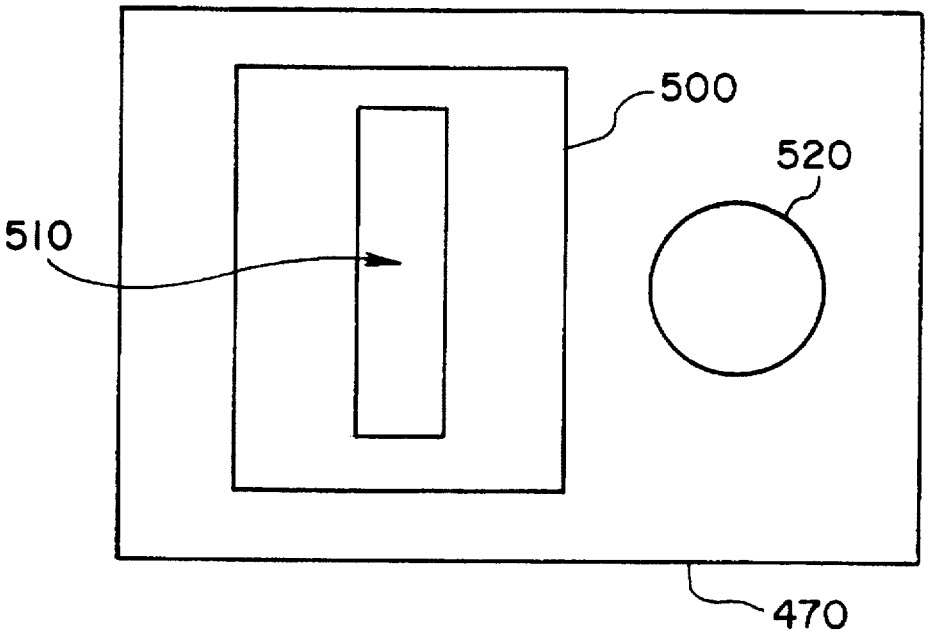
Fig. 5 (Prior Art)

The shuffled cards (whether automatic or live) are delivered into a shoe 250 for dealing by the dealer D. The shoe 250 may be of the type, but not limited to, conventionally taught in U.S. Pat. No. 5,374,061 that requires the use of a specially coded deck of cards. Card 300 in another embodiment, shown in FIG. 3, is imprinted with a code in region 310. As each card is passed through the shoe 250 from the shuffler 240, a reader in the shoe 250 reads the code in region 310 and delivers a signal over a line 252 to the game control GC. The shoe 250 transmits to the game control GC the identity of the card being dealt by the dealer D. This identity includes the value of the card, the suit of the card, and, in one embodiment, the identity of the deck the card is from. All of this occurs without the dealer or any player knowing what the card is. The identity of the deck is critical as this prevents unauthorized interchanging of playing cards (i.e., adding marked cards) either by the dealer or by a player or by a combination of the dealer and a player. In addition, the three identity values are used to fully record in the game control GC the history of each hand (and, therefore, of each game) as it is delivered by the shuffler 240 into the shoe 250 and is dealt by the dealer D.

It is to be understood that even though a specially coded card is utilized, any variations on this concept could be incorporated. For example, rather than using a coded card 300 as shown in FIG. 3, an optical image of each card could be obtained at the shoe, delivered over line 252, and stored in the game control GC as taught by the above-identified German patent application. While this approach requires more memory, it also provides a digital image of each card as it is dealt from the shoe 250. When the dealer D deals a card from the shoe 250, the game control GC knows the identity of the card being dealt. Once the image is received for each card, the game control GC using pattern recognition software can read the value and suit of each imaged card.

In another embodiment, a separate circuit 246 may be placed on the shuffler 240 to count the cards inserted from the previously dealt hand and to read each card deck identity on each inserted card to verify, that the same number of cards dealt in that hand are delivered back into the shuffler 240 and (2) that the cards placed into the shuffler 240 are the actual cards dealt based on deck identity. This circuit 246 can be, but is not required to be, the same kind of reader that is found in the shoe 250, reading the same code or taking the optical image of the card as it is deposited into shuffler 240. This prevents a player (or dealer) from withholding cards or from substituting cards. An alarm signal is sounded when a wrong count occurs. If a deck identity code is used, an alert signal is sounded when a card is not verified as being from the deck. The count and verification signals are issued over a line 248 to the game control GC. In this embodiment, an infrared deck identity code, invisible to a player's eyes, may be imprinted on each card in, for example, region 310. The circuit 246 located in the shuffler 240 reads the imprinted deck identity code and issues a signal corresponding to the read code over line 248 to the game control GC.

In yet another embodiment, the circuit 246 and the shoe 250 both incorporate optical readers, thereby enabling the game control GC to verify that the same number of cards, each of the same value and suit, were returned to shuffler 240 as were dealt from the shoe 250. In the most secure embodiment of the invention, the circuit 246 and the reading device in the shoe 250 are incorporated into the same shuffler 240 as will be discussed later with respect to FIGS. 12–17. Thus, once a card is read by the circuit 246 it enters a secure environment within the shuffler 240 where it cannot be touched again by human hands until it has made its way through the shuffler 240 and is presented to the dealer through the shoe 250. When dealt its value and suit are read and recorded in the game control GC.

3. Play Area

Figure 4:
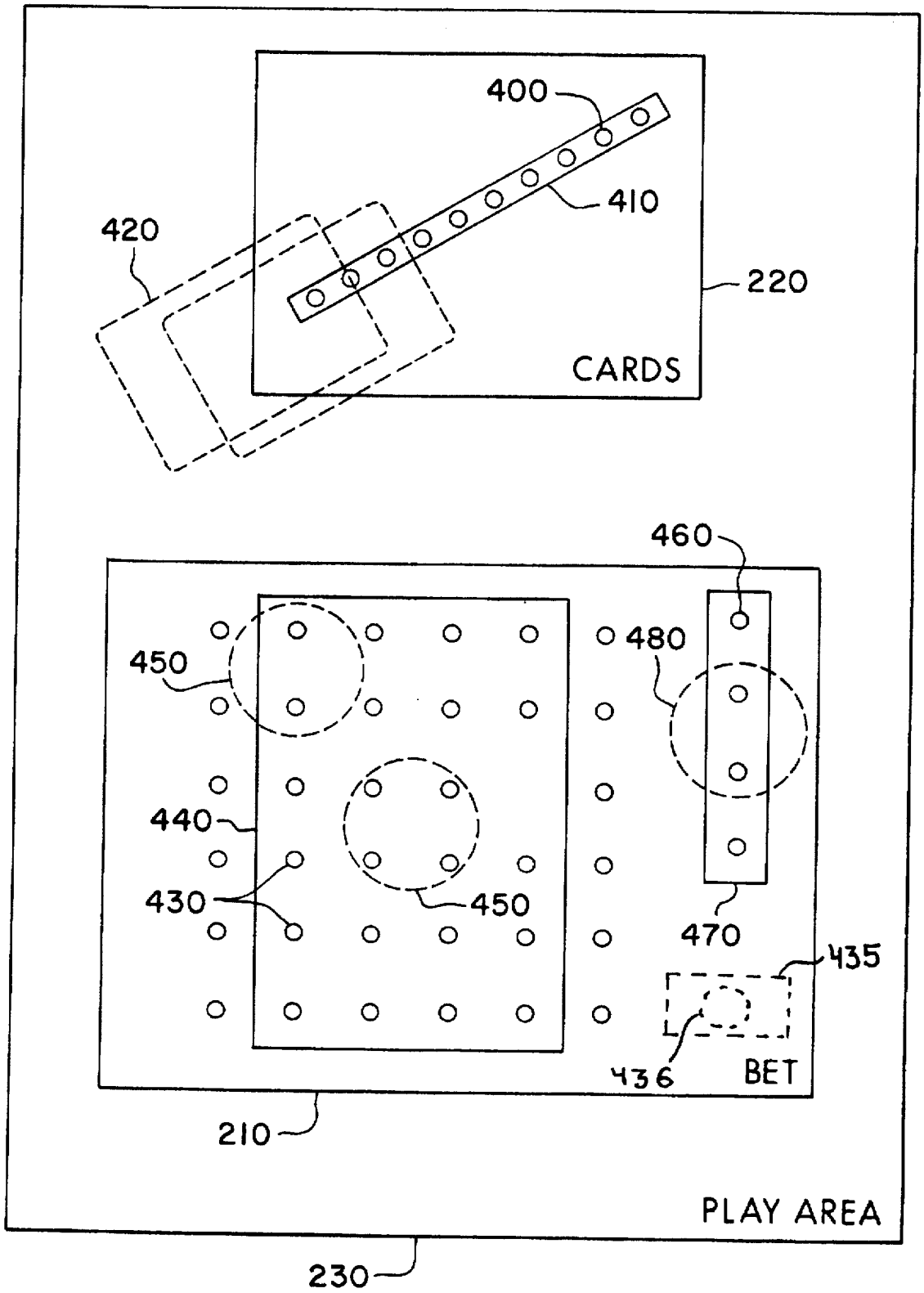

The details of each play area 230 are shown in FIG. 4.

Each play area 230, as mentioned, has a card-receiving area 220 and a betting area 210. In the card-receiving area 220 are placed a plurality of sensors 400 located in a predefined region 410. The sensors 400 could be photocells or any suitable sensors that are individually interconnected over lines 222 to the game control GC. Playing cards 420 are placed in the card-receiving area 220 by the dealer D, and as each card 420 is placed over the sensors 400, the placement of the card 420 by the dealer D is detected and recorded by the game control GC. Hence, the game control GC accurately records the delivery of a card 420 to a play area 230 of a particular player position P.

It is to be understood that the region 410 and sensors 400 are optional under the preferred teachings of the present invention. When each card 420 is dealt to a player having placed a game wager, the game control GC reads the identity of the card in the shoe 250 and tracks, according to the rules of the card game, the cards each player receives. The sensors 400 provide optional added security as taught in the above identified related application.

Also in the play area 230 is a betting area 210 that has a plurality of sensors 430 located in a betting region 440 for detecting the presence of a coin or token 450 corresponding to a game wager. The sensors 430 are interconnected over individual lines 212 back to the game control GC. The game control GC senses the presence of each token 450 and provides a count and, optionally, a value.

The sensors 400 and 430 and the regions 410 and 440 are conventional and are found in the German patent application identified above.

The fact that a game bet is placed is important. Hence, the presence of the game bet enables the game control GC to identify the player position and to correlate the cards delivered to that player position as will be explained.

In another preferred embodiment and as taught by the above-identified German patent application, sensors 430 are not used. Rather, each gaming token 450 has an embedded smart or security chip with identity and value information contained therein. When gaming tokens 450 are stacked in the betting area 210, a receiver located under the table in the betting area 210 reads the value of the game wager when electromagnetic signals are transmitted from a transmitter.

Any number of devices could be used to detect the placement and value of game wagers in either betting region 440 or betting area 210, and the present invention is not to be limited to photocells or to embedded chips. For example, coin acceptors, credit or debit card readers, or optical image cameras could be used in either or both areas.

4. Operation

Figure 6A:
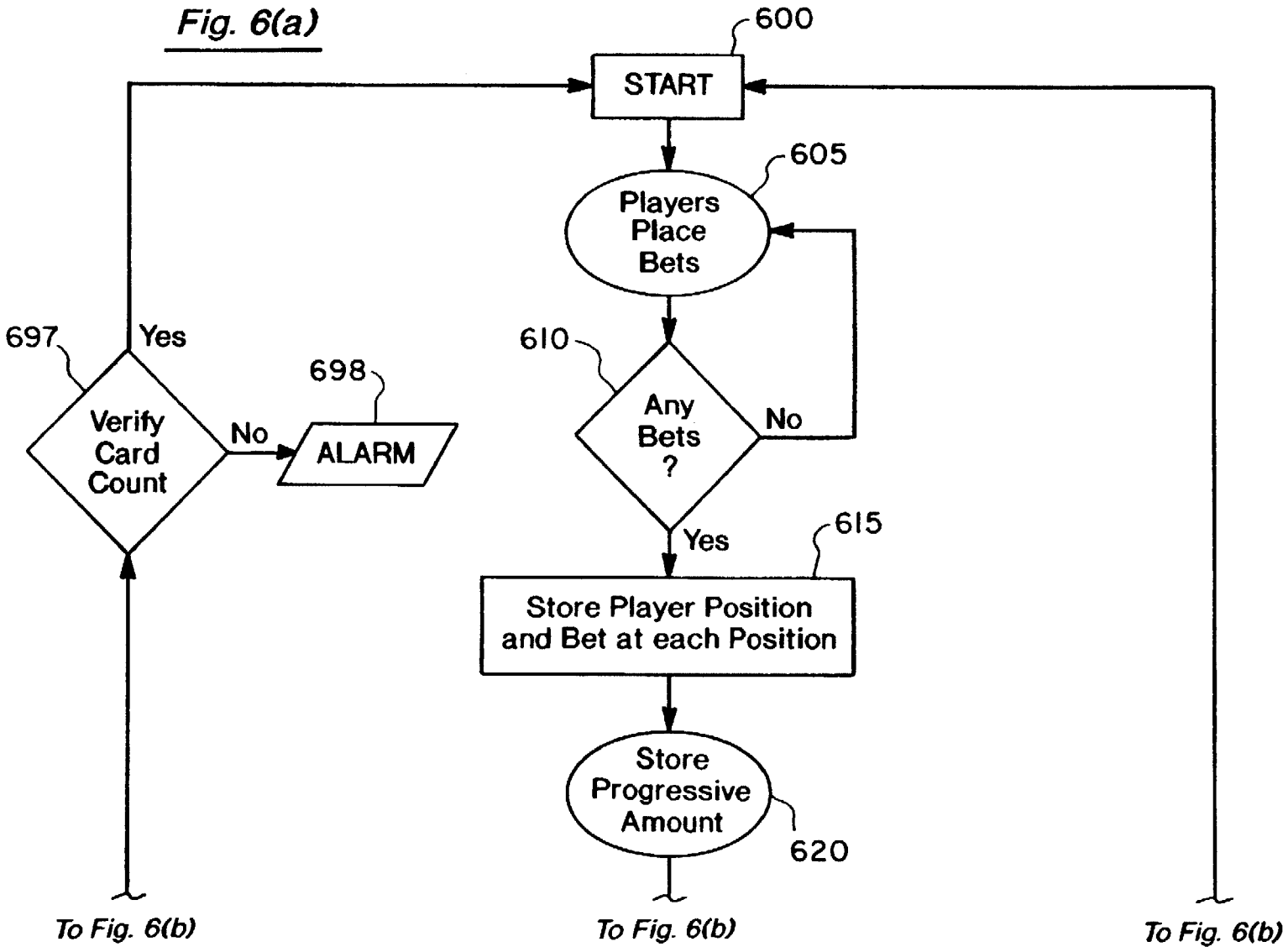
Figure 6B:
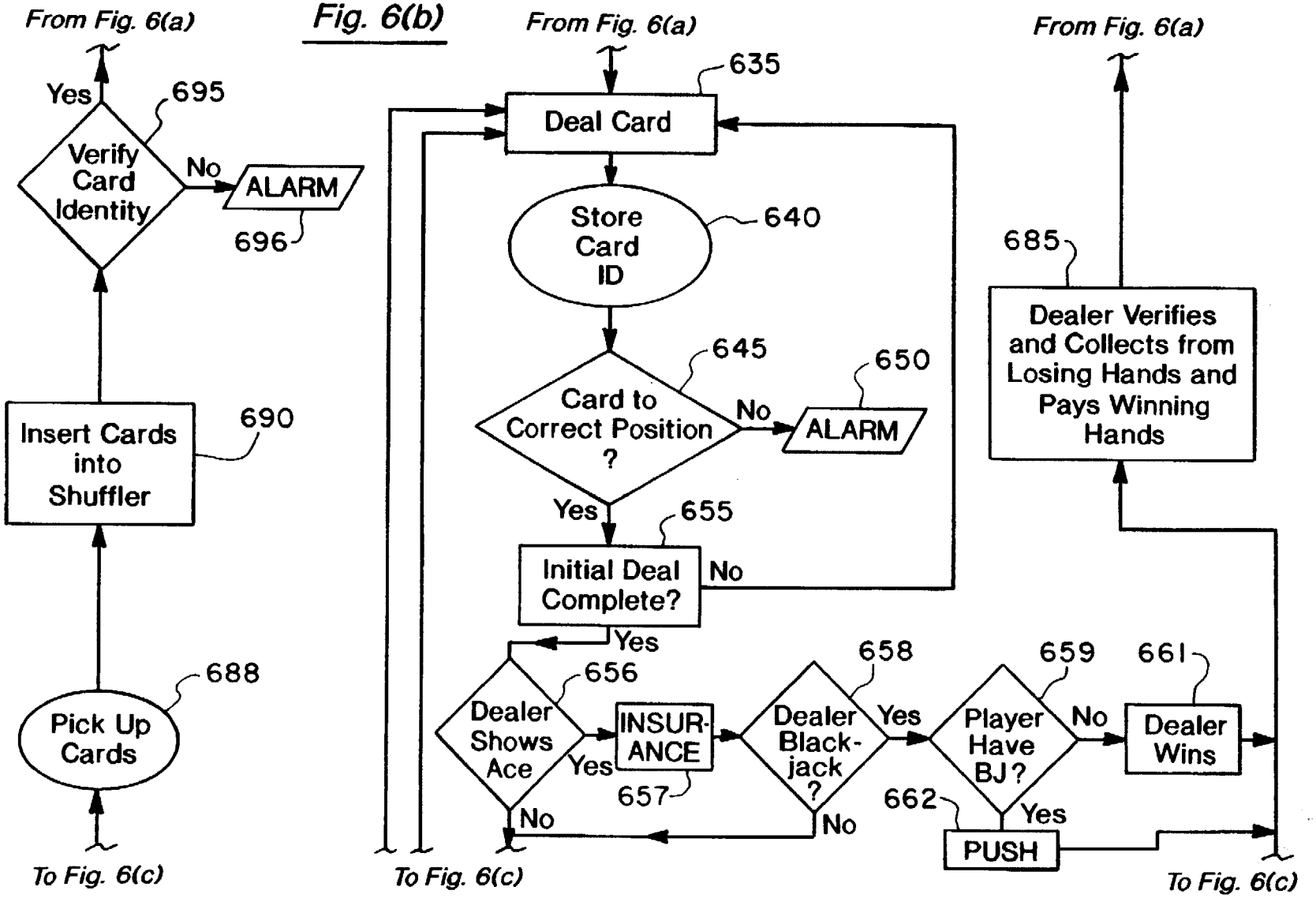
Figure 6C:
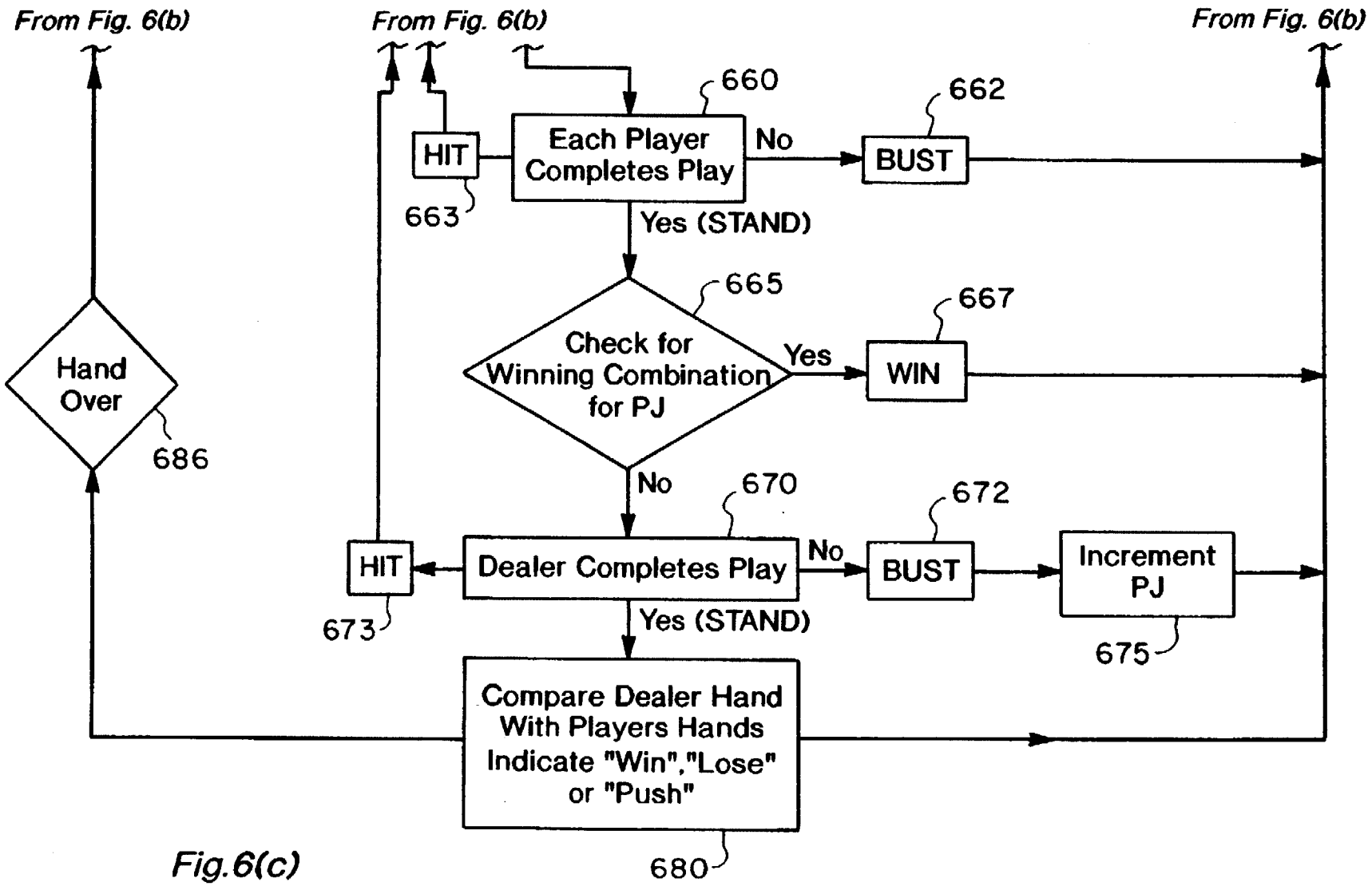

In FIG. 6, the operation of the system 10 of the present invention is set forth with play at a particular table. With reference to FIGS. 2 and 4, the operation of the present invention occurs as follows. At the start of the game 600 the players are requested to place bets.

EXAMPLE I

Assume in FIG. 2 the following game configuration for blackjack, which illustrates increasing the progressive jackpot in the event the dealer goes over 21:

TABLE I

| Player Position | Game Bet | Cards Dealt | | |
|---|---|---|---|---|
| A | — | | | |
| B | 2 ($20) | 10C | 7H | STAY |
| C | — | | | |
| D | 1 ($10) | JS | 2H | 5C |
| E | 3 ($30) | 3D | QC | KH |
| Dealer | | 10H | 3S | JD |
| | TOTAL $60 | | | |

Where

10C=10 of Clubs

JS=Jack of Spades

3D=3 of Diamonds

10H=10 of Hearts

7H=7 of Hearts

2H=2 of Hearts

QC=Queen of Clubs

3S=3 of Spades

5C=5 of Clubs

KH=King of Hearts

JD=Jack of Diamonds

The start of the hand may occur several ways. For example, when the cards are played in the immediately prior hand and returned to the shuffler, the shuffler 240 counts and verifies the returned cards. When this task is complete, a new hand begins as determined in the game control GC. Or, a switch in circuit 246 can be pressed causing shuffling to occur or to indicate a new hand. Or, the first card dealt from the shoe 250 is detected over line 252.

With reference to FIG. 1, the card game starts at stage 600. The players place game bets in stage 605 as set forth in Table I. The game control GC interrogates the betting areas 210 of each player position 230 and ascertains that bets have been placed in stage 610. If no bets have been placed, it returns to the placement of bets stage 605 and cycles. When bets are detected, the game control GC determines the value of the bets in betting region 440. The game control GC stores in memory for each player position the game bets placed in region 440 in stage 615 and stores a progressive amount of the total value of the game bets in stage 620. In Table I, for example, players A and C did not place bets. Players B, D, and E placed game bets of 2, 1, and 3, respectively. If a 10% progressive percentage is used, and each token is $10, then the progressive jackpot may be increased by $6. At this point, the game control GC, for each player position that has a game bet placed, has stored that information in memory in stage 615 and the amount of $6 is stored in stage 620.

The dealer deals the first card in stage 635 from the shoe 250 to the first player position with a bet (i.e., $P_B$ in Table I). The game control GC stores the identity (or the optical image) of the first card dealt from the shoe in stage 640. This includes the card count. The dealer places the first card in the card receiving area 220 over region 410 for Player $P_B$ as shown in FIG. 4. The delivery of the card to this player region 410 by the dealer is sensed by sensors 400, and the game control GC makes a decision in stage 645 as to whether the card was, in fact, delivered to the correct position. The correct position is determined by the rules of blackjack as follows. The game sequence proceeds from player position $P_A$, $P_B$, . . . to the dealer D, but skips all players not placing a game bet. Different live card games have different game sequences, which are programmed into the game control GC.

If an invalid situation occurs by delivering a card to a wrong position, an alarm signal 650 is raised in stage 645 for delivery to alarm 270. For example, if the card is delivered to player position $P_A$ (in our example), then an alarm signal 650 would be raised and delivered to alarm 270. However, if the card is delivered to the correct player position in sequence, which in Table I is player position $P_B$, then the game continues with each player and the dealer receiving two cards and the game enters stage 655. Stage 656 will be discussed with respect to Example II. At this point, as shown in stage 660, the game control GC interrogates each hand in sequence to determine whether the player elects to receive additional cards ("hits") or not ("stand"). Some players taking "hits" (663) might "bust" (662) and the dealer would collect the wagers made by those players at stage 685. As each player completes his hand (by "standing" or "busting") the game enters stage 665, where the game control GC analyzes the hand to determine whether the player has been dealt a predetermined combination of cards qualifying that player to win the progressive jackpot. If the player has been dealt a winning combination (667), the game control GC signals the dealer, the dealer verifies the combination, and the player is paid at stage 685. During the course of play, the game control GC monitors each hand at each position and alerts the dealer when a player "stands" or has "busted." When all of the players have had the opportunity to "hit" or "stand," the game enters stage 670 where the dealer reveals his hand in its entirety and, according to the rules of blackjack, must draw cards ("hit") until his cards total 17 or more. If the last "hit" (673) causes the dealer's card count to exceed 21, he "busts" (672). At the conclusion of the hand shown in stage 680, the game control GC will record all hands and designate each as a "win," "loss," or "push" (tie). If the dealer has "busted," the game control GC will increment the progressive jackpot at stage 675 in accordance with the amount set at stage 620 of the amount of total bets recorded at stage 615.

With respect to our example, and as shown in the above chart, Player B receives a 10 of Clubs, Player D a Jack of Spades, and Player E a 3 of Diamonds. The dealer receives a 10 of Heads. The game control GC has stored in memory the identity of each card with respect to each player position 230 in sequence that has placed a game bet and has verified that the cards were correctly delivered to the proper player positions 230.

The deal continues with Player B receiving a 7 of Hearts, Player D a 2 of Heads, and Player E a Queen of Clubs. The dealer receives a 3 of Spades. Again, the game control GC has stored the identity of each card received at each player position 230 and at the dealer position 224. The game control GC has verified that each card has been delivered to the correct player position 230.

Player B decides to stay and not receive another card. As taught by the above-identified German patent application, Player B may push a stay or hold button, not shown, that informs the game control GC and lights a light informing the dealer that Player B does not wish a new card. Player D decides to take a card and receives a 5 of Clubs and Player E then receives a King of Heads. Player E, of course, went over 21 and hence the play is between Player D and the dealer. In this example, the dealer must take a new card and receives a Jack of Diamonds and goes bust. Players B and D win and the dealer pays. Under the teachings of the preferred embodiment of the invention, when the dealer goes bust this represents an event for incrementing the progressive award by the predetermined percentage. As shown in FIG. 6(*b*), in stage 670, the dealer's hand is analyzed electronically. If the dealer's hand is over 21 (i.e., broke or busted), then stage 675 is entered and the progressive jackpot value is incremented by the progressive value determined in stage 620. In the above example, the dealer's hand is over 21 and the progressive percent of 10% times the total game bet of $60 results in an increment of $6.00. It is to be understood that other subsequent game bets could be made by players and sensed such as splits, insurance, etc., as taught by the German patent application and may or may not be incorporated into the progressive contribution, as desired, under the teachings of the present invention. The preferred embodiment is to base the contribution on the ante. The contribution could be a percentage or a fixed amount.

When the hand is over 686, the dealer picks up the cards 688 and inserts the played cards 690 into the shuffler 2240. As the shuffler 240 takes each inserted card to be added to the cards being shuffled, the circuit 246 counts each card and issues a count signal over line 248 to the game control GC. In one embodiment, the circuit 246 reads the card identity code 310 (which may include the deck identity) on each card and delivers that reading back to the game control GC over line 248. The game control GC verifies in stage 695 the correct deck and, if not, raises an alarm signal 696 for delivery to the alarm 270 over line 272. If the card is of the correct deck, then the cards are fully counted and the game control GC in stage 697 verifies the correct count. If the count is not correct, then an alarm signal is raised 698 for delivery to the alarm 270. A new deal 600 commences if the count is correct.

In one preferred embodiment for an integrated shuffler/shoe of FIGS. 12–17, discussed later, stages 640, 695, and 697 would occur through tracking (and storing) of digital images of a portion, or all, of the face of a card. As each card leaves the shoe 250, an image is captured and stored, and the captured images are counted to arrive at a count. Upon completion of a hand, the cards are inserted into the shoe 250, images are again captured and stored, the captured images are counted. The counts from these two operations are compared, and if they are not the same, an alarm 698 is raised. The images are compared, and if they are not the same, an alarm 696 is raised.

It is to be expressly understood that the security steps discussed above are optional to the teachings of the present invention as it relates to the progressive contribution based on the progressive contribution being made upon the occurrence of a predetermined game event (e.g., dealer going bust) in the game and the progressive jackpot payout to a player having a winning combination—all based on the game wager and not based upon a separate progressive wager.

Furthermore, the flow charts in FIGS. 6(*a*) and 6(*b*) are for purposes of illustrating the game of blackjack, and other flow charts for different live card games could be similarly developed.

In Example I, each player placing a bet normally played the game of blackjack without placing a separate progressive wager. Yet, when a game-controlled event occurred (i.e., the dealer going bust), a progressive jackpot contribution was made automatically by the system without affecting the players' game wagering. Each player knew the contribution was made when the dealer went bust, thereby adding excitement to the game. An announcement of this event could also be made audibly or graphically on display PJ. In Table I, the house paid Player B $20, Player D $10, and Player E $30. Each of these players received their wagers back. The house also contributed $6 to the progressive jackpot.

EXAMPLE II

Assume the following blackjack example, which illustrates a normal game of blackjack without contributing to the jackpot:

TABLE II

| Player Position | Game Bet | | Cards Dealt |
|---|---|---|---|
| A | 2 ($20) | 4C | 10S |
| B | 2 ($20) | 9H | 3H |
| C | — | | |
| D | — | | |
| E | 3 ($30) | 2S | QC |
| Dealer | | KH | AS |
| | TOTAL = $70 | | |

Where

4C=4 of Clubs

9H=9 of Hearts

2S=2 of Spades

KH=King of Hearts

10S=10 of Spades

3H=3 of Hearts

QC=Queen of Clubs

AS=Ace of Spades

Here the cards are dealt, their identities are stored, and the position of each card is recorded and verified for each player and the dealer. However, in this example, when the dealer is dealt the Ace of Spades, the game control GC knows that the dealer has a winning 21 card combination and the game control GC in stage 656 raises a win signal 661 that the dealer has 21 and delivers it to the win circuit 280. Stage 658 determines the dealer's blackjack. If the dealer has a blackjack, stage 659 determines whether a player has a blackjack and, if so, pushes 662. After all insurance bets 657, if any, are registered, the dealer is notified by the game control GC that he has a winning hand. The dealer in stage 658 verifies this by turning the cards over for all to see. This adds a significant level of security since in some conventional blackjack games, the dealer initially looks at the hole card when he has a face card or ace to see if he has 21. The dealer may then be able to signal other players in the game information concerning his hand. The present invention eliminates this possibility from occurring.

In this Example, the progressive jackpot was not incremented by a percentage of the total game bet since the dealer did not go bust and stages 672 and 675 were not entered. The game was played conventionally in all aspects. The Players A, B, and E each lost and their bets were taken by the house.

The presence of the progressive feature was entirely transparent to the players in this Example.

EXAMPLE III

The following blackjack example illustrates both the progressive jackpot win characteristic of the present invention and a contribution to the progressive jackpot. For this example, the progressive win sequence is assumed to be the Ace, Two, Three, Four, and Five of Spades in any order.

TABLE III

| Player Position | Game Bet | Cards Dealt | | | | |
|---|---|---|---|---|---|---|
| A | 3 ($30) | AS | 4S | 3S | 5S | 2S |
| B | — | | | | | |
| C | 2 ($20) | 5D | JH | 4C | | |
| D | 2 ($20) | QC | KD | | | |
| E | — | | | | | |
| Dealer | | 10H | 2H | JC | | |
| | TOTAL = $70 | | | | | |

Where

AS=Ace of Spades
5D=5 of Diamonds
QC=Queen of Clubs
10H=10 of Heads
2S–5S=2 through 5 of Spades
JH=Jack of Hearts
4C=4 of Clubs
KD=King of Diamonds
2H=2 of Hearts
JC=Jack of Clubs Players A, C, and D and the dealer receive their first two cards as conventional in the game sequence for blackjack. Player A then elects to receive three additional cards (i.e., in the game sequence "hits") and ends up with a progressive jackpot win sequence of: Ace of Spades, 2 of Spades, 3 of Spades, 4 of Spades, 5 of Spades. The system in stage 665 determines the sequence (as well as the identity of player $P_A$) and issues a win signal 667 and delivers it to the win circuit 280. The dealer D verifies in stage 685 the winning progressive sequence. The game continues to play, with Player C receiving a 4 of Clubs and Player C holding, Player D holding, and the dealer D going bust. The fact that the dealer went bust is detected in stage 672 and the next progressive jackpot is incremented in stage 675 by 10% of $70 or $7. Here, the house contributed $7 to the progressive jackpot. Player C was paid $20 and Player D was paid $20 by the house. Player A won the progressive jackpot and may or may not (depending on how the house implements the present invention) be paid $30. In all cases the players have their wagers returned.

If the dealer D rather than receiving a Jack of Clubs as in this Example received an 8 of Spades, the dealer would push with Player D and win over Player C. In this situation, no progressive contribution would be made as the game-controlled predetermined event did not occur.

EXAMPLE IV

The following blackjack example illustrates a variation of the present invention wherein the contribution to the progressive jackpot is made automatically as a predetermined percentage of a specific portion of the initial wager by the player. In this example, the operator of the game has programmed the central control 20 to allow the progressive jackpot to increment $0.50 each time a player makes an initial wager of $6 or more. The game is further programmed so that only players making an initial wager of $6 or more will qualify to win the progressive jackpot. For this Example, the winning combination for the progressive jackpot is two blackjacks (achieved when a player is dealt a pair of aces that are then split and the player thereafter draws two cards each with the value of 10).

TABLE IV

| Player Position | Game Bets | Cards Dealt | | | |
|---|---|---|---|---|---|
| A | $10 | 8S | 3C | 9D | |
| B | $5 | 6H | 9H | | |
| C | $15 | 9C | 10H | | |
| D | $20 | 7S | 2C | QD | |
| E | $5 | AC | AD | JD | JS |
| DEALER | | 8H | 6S | 4D | |
| | $55 | | | | |

Where

8S=8 of Spades
6H=6 of Hearts
9C=9 of Clubs
7S=7 of Spades
AC=Ace of Clubs
8H=8 of Hearts
3C=3 of Clubs
9H=9 of Hearts
10H=10 of Hearts
2C=2 of Clubs
AD=Ace of Diamonds
6S=6 of Spades
9D=9 of Diamonds
QD=Queen of Diamonds
JD=Jack of Diamonds
JS=Jack of Spades
4D=4 of Diamonds Players A through E and the dealer receive their first two cards as conventional in the game sequence for blackjack. Player A then elects to "hit" once, receiving one card. Players B and C elect to stand. Player D "hits" and receives the Queen of Diamonds and then stands. Player E, who was dealt a pair of aces, splits them and receives a Jack of Diamonds and a Jack of Spades, thus achieving the sequence qualifying for the progressive jackpot. The system 10 in stage 665 notes the sequence, the player position, and the initial bet made by Player E. But because Player E only bet $5, he did not qualify to win the progressive jackpot and the system 10 recognizes this. The game continues with the dealer hitting and receiving the 4 of Diamonds. The results of the game are recorded in the game control GC and transmitted to the system 10 for storage and later retrieval if the operator wishes.

A variation on Example IV would be to configure the game so that the first $0.50 of each wager incremented the progressive jackpot, thereby allowing every player who bets $0.50 or more to qualify. If the game had been configured in that manner in Example, IV, Player E would have had a qualifying sequence of cards and a qualifying wager and would have won the progressive jackpot.

EXAMPLE V

The following example illustrates another variation of the present invention where a fixed or progressive jackpot is paid on a separate "proposition bet" made by a player. In this example, the operator of the game has programmed the Central Control 20 to allow players to place a "proposition bet" that pays 30 to 1 when a "proposition event" such as the dealer is dealt blackjack. In this configuration of the game, there is a separate area 435—shown in dotted lines in the betting area 210 to place a proposition bet 436 on this proposition. Bets made in this area are automatically detected in the same fashion detected above and the Game Control GC is programmed to record a win for that player if the proposition bet is successful.

TABLE V

| | Game Bets | Proposition Bet | Cards Dealt |
|---|---|---|---|
| A | $10 | | 8S, 3C |
| B | $5 | $5 | 6H, 9H |
| C | $15 | | 9C, 10H |
| D | $20 | $1 | 7S, 2C |
| E | $5 | | AC, 9S |
| DEALER | | | AS, 10S |
| | $55 | $6 | |

Where

8S=8 of Spades

6H=6 of Hearts

9C=9 of Clubs

7S=7 of Spades

AC=Ace of Clubs

AS=Ace of Spades

3C=3 of Clubs

9H=9 of Hearts

10H=10 of Hearts

2C=2 of Clubs

AD=Ace of Diamonds

9S=9 of Spades

10S=10 of Spades

Players A through E and the dealer receive their first two cards as conventional in the game sequence for blackjack. Because the dealer was dealt a blackjack, the game ends and all bets are paid and collected. In this example, no player was dealt a blackjack so all players lose. However, player B and D made proposition bets that pay 30 to 1 (i.e., the proposition jackpot) where the dealer is dealt a blackjack (i.e., the "proposition event"). Accordingly, although they lose their game bets of $5 and $20, respectively, they win their proposition bets. Player B wins $150 and Player D wins $30. Any suitable multiple of the proposition bet could be awarded under the teachings of the present invention. The betting, cards dealt to each player and the results of the game are automatically sensed under the teachings of the present invention and recorded in the Game Control GC and transmitted to the System 20 for storage and later retrieval if the operator wishes.

A variation of this example would be to combine a fixed jackpot and a progressive jackpot on the same proposition bet. For example, any blackjack dealt the dealer could pay 20 to 1 with a specific blackjack, say the Ace of Spades and the Jack of Spades (i.e., "the proposition event"), paying a progressive jackpot in addition to the fixed payout. The progressive jackpot would be split equally among all players making the proposition bet at the time. In this example, the Game Control would be programmed to increment the progressive jackpot $0.25 every time a proposition bet is made. Using the cards indicated as dealt in Table V, player B would receive $100 plus one-half of the progressive jackpot and player D would receive $20 plus one-half of the progressive jackpot.

In FIG. 7 the details for the stage 665 of FIG. 6 for determining the progressive winner are set forth. Since the game control GC knows the identity of each card as it leaves the shoe 250 of FIG. 2, when a winning combination of cards 700 is detected and it is for the same player position 710, then a progressive win has occurred. It is to be expressly understood that any winning combination of cards can be programmed into the game control GC either at the table or from the main central control 20 as shown in FIG. 1 over the communication link L. It is also to be expressly understood that the cards do not necessarily have to come out in the exact sequence, only that a winning combination occurs. Hence, if the winning combination was: Ace, King, and Queen of Hearts, the following detected sequences of Hearts would result in a winning combination: Ace King Queen, Ace Queen King, King Queen Ace, King Ace Queen, Queen Ace King, and Queen King Ace. Regardless of the time sequence that the cards were dealt in the hand to the winning player position, the winning progressive combination for that player position is detected.

Under the teachings of the present invention, upon the immediate detection of a progressive winning combination at a qualifying player position, the game control GC for that table issues a winning signal 667 not only to that table but to the central control 20 over link L, which can notify all the other tables.

It is to be understood that while a preferred order of operation is set forth, variations may occur under the teachings contained herein. For example, stages 697 and 695 could occur in any order.

5. Predetermined Game Event

Under the teachings of the present invention a predetermined game event occurs in a hand of a live card game that triggers the contribution to progressive jackpot. In the examples of Tables I & III, the predetermined event is based on the rules of the live card game, which for the game of blackjack was the dealer going bust. In Example IV the qualifying event was a player wagering $6 or more. Other game events could be chosen for the game of blackjack. For example: the dealer getting 21, each time the dealer wins over a player's hand, each time a player wins over the dealer's hand, the start of each game, etc. This list of predetermined game events for blackjack is not meant to be exclusive or exhaustive.

Under the teachings of the present invention, more than one progressive contribution could also be made. In the case of setting the game event to be whenever a player receives a 21, it is possible for several players in a game to receive a 21. For each player that received 21, a progressive contribution would be made to the progressive jackpot. In this illustration, the progressive contribution might be a percentage of the bet (e.g., 3%) or a fixed amount (e.g., $1).

If the start of the game constituted the predetermined game event, then each game would cause a percentage or fixed amount of the game wager made by all players to be contributed each game. In this example, the flow chart of FIG. 6 would be modified to delete stage 675 and to make the progressive contribution in stage 620 (when based on the initial game wager).

In the preferred embodiment, and for blackjack whenever a dealer goes bust, not only do one or more players win, but an added level of excitement occurs since all players know that a contribution is being made to the progressive jackpot.

It is to be expressly understood that live card games may be played with no progressive contribution being made. For example, in the game of blackjack and when the predetermined game event is "the dealer going bust," several games may occur without a progressive contribution. Furthermore, a player may have a winning progressive sequence of cards in a game and win the progressive jackpot even when a contribution was not made. In all cases, the player is never required to place a separate progressive bet. The game wagering by the player is fully valued for the play of the game.

6. Winning Progressive Sequence of Cards

Under the teachings of the present invention, a winning card sequence (i.e., a hand of predetermined cards) occurs in a player's hand that results in the award of a progressive jackpot. In the example of Table III, above, the winning sequence was ace, two, three, four, and five. In the example of Table IV, the winning sequence was two blackjacks, Other winning card sequences, as mentioned above, could also be chosen for blackjack. Indeed, more than one sequence could be used, which would result in more than one progressive award. For example, the following awards could be made based on single or multiple decks in the game of blackjack:

TABLE VI

| Winning Card Sequence | Progressive Award |
|---|---|
| Four Blackjacks | 100% |
| Three Blackjacks | 20% |
| Two Blackjacks | 10% |

Again, any suitable card sequences that a player may receive whether in precise order or in any order (as determined by the program) may result in a single progressive award or in a number of progressive awards as set forth above. This also adds excitement to the normal game of blackjack in that as the cards are dealt, each player eagerly anticipates winning a progressive award.

Under the teachings of the present invention, the contribution is generally a fixed percentage as discussed above. For example, the percentage could be 10% of the initial game bet, 5% of the total bets placed in a game, or any suitable percentage amount. But the contribution could also be a fixed amount, e.g., the first 50¢ of each wagered by each player or 50¢ of each wager of $6 or more. Under the teachings of the present invention each player places an ante wager on their bet region. The value of the ante is automatically sensed. Money is accumulated for the jackpot based on the sensed value of the ante. The ante itself remains unaffected.

What has been described is providing a progressive jackpot environment to a live card game such as blackjack while minimizing interference with the normal play of the live card game. Under the teachings of the present invention, only the game bet is made by the player—a separate progressive bet is not made. Hence, the activity found in prior art progressive live card games relating to individual players separately placing progressive bets does not occur. The present invention automatically reads the bets, automatically knows the card contents of each hand, automatically detects when a contribution to the progressive jackpot is to be made, and automatically determines the presence of winning card sequences without the additional hardware required for determining, calculating, and processing separate progressive bets as found in prior art approaches.

While the examples set forth above are directed towards the award of a progressive jackpot, the system and method of the present invention, in another preferred embodiment, awards game or table jackpots independent of or in combination with progressive jackpots. A game or table jackpot is simply a jackpot that is awarded to a player when a player receives a winning sequence of cards at the table.

TABLE VII

| WINNING CARD SEQUENCE | GAME JACKPOT AWARD | PROGRESSIVE JACKPOT AWARD |
|---|---|---|
| Blackjack | — | — |
| Two Blackjacks | $100 | — |
| Three Blackjacks | $1000 | — |
| Four Blackjacks | — | Progressive Jackpot Award |

In Table VII, when a player receives a single blackjack (i.e., any sequence of cards having an ace and another card having value of 10), then no game jackpot award or progressive jackpot award is made. However, if a player is dealt two aces, the player can split and play the two aces separately. In that event if the player receives two blackjacks the player would also receive a game jackpot award of $100. The game award could be made per blackjack (for example $50 per blackjack amounting to $100) or the player could receive a game jackpot award simply for having the two blackjacks (i.e., simply receiving $100). Again, no progressive jackpot award is made. In the event the player receives two aces and splits the two aces and then receives a third ace, the player can then split the third ace and play the three individual aces. In the event the player receives three blackjacks, the player can then receive a game jackpot award such as $1,000 in addition (or in place of) the prior game award. In the event the player receives two aces and splits the two aces and then receives two more aces which are also split, then if the player then receives four blackjacks, the player wins the progressive jackpot award. The game jackpot awards could also be given in this event for the second and third blackjacks.

Under the teachings of the present invention winning card sequences could also occur when a player receives:

a Two aces and one blackjack,

Three aces and one blackjack,

Three aces and two blackjacks,

Four aces and one blackjack,

Four aces and two blackjacks, or

Four aces and three blackjacks.

All of these winning card sequences are designed to add excitement to the conventional game of blackjack.

7. Game Control

In FIG. 8, the details of the game control GC are set forth to include a processor 800 and input circuits 809, 810, 820, 830, and 840. Conventional inputs, outputs, and monitors are not shown. Input circuit 809 receives the count signal and, in one embodiment, the deck identity signals from the circuit 246 issued over line 248 and delivers them over line 811 to the processor 800. Input circuit 810 receives the signals from the shuffler 240 issued over line 244 and delivers them over line 812 into the processor 800. Input circuit 820 receives the identity of the card signals from the shoe 250 that are issued over line 252 to circuit 820. If the identity of the card is based on a bar code, the signals coming in over line 252 could be digital. However, if an optical image of the card is taken, then line 252 may be a video data bus and circuit 820 is a conventional video input circuit for the processor 800. Input circuit 830 is connected to lines 222 and receives signals on the receipt of cards in area 220. Input circuit 840 is connected to lines 212 which receive inputs from the sensors 430 in the bet region 210. The processor 800 is connected to a driver circuit 850 that delivers display signals over lines 852 to the progressive jackpot display PJ. The processor 800 is connected to a standard I/O port 860 that is connected to the communications link L and in turn is connected over lines 862 to the processor. In some environments, the I/O port 860 could be a modem. The processor 800 is also interconnected to a memory 870. The current value of the progressive jackpot PJ is stored in a memory 872. The player position 874 is stored, and for each player position the game bet history 876 is stored and the identity of the cards played 878 are stored. If an optical image of each card in the shoe 250 is made, the card memory storage 878 is designed to hold larger amounts of data.

With reference to FIG. 6, in stage 615, the player position is stored in memory 874. The bets with respect to that player position in stage 620 are stored in memory 876. Finally, the individual hands for a game area stored in stage 640 are placed into memory 878.

It is to be understood that the hardware configuration of FIG. 8 can comprise any suitable hardware configuration but that in the preferred embodiment the processor 800 is a conventional 486 micro-processor or any of the PENTIUM® series of processors.

8. Central Control

Figure 9:
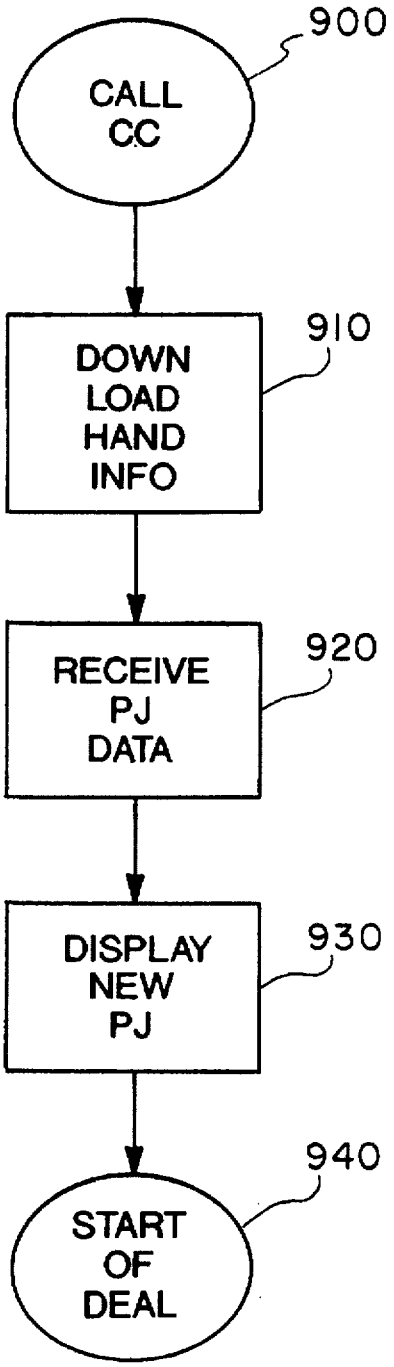
FIG. 9 is a master control flow chart setting forth the communication with the central control.
Figure 10:
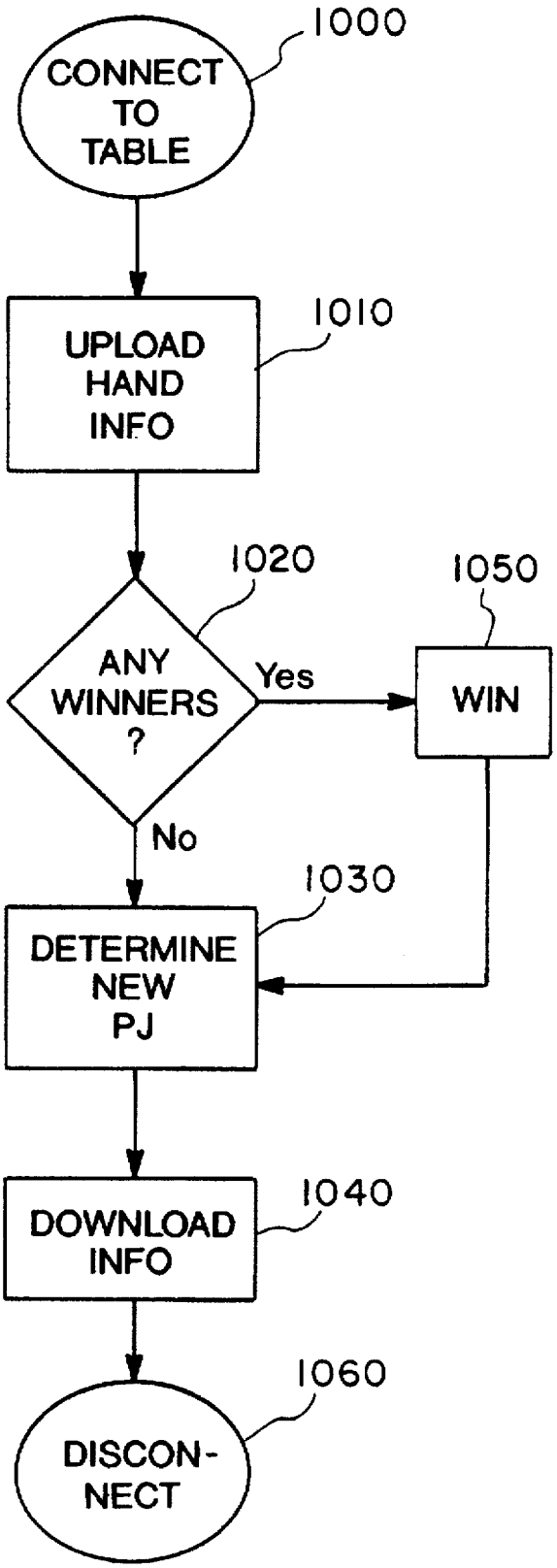
FIG. 10 is a central control flow chart setting forth the communication with a game control.

In FIGS. 9 and 10 the flow between the central control CC 20 and each gaming table 200 is set forth.

From the gaming table 200 viewpoint, and in the game master control, the central control CC 20 is selectively called in stage 900 over the communication link L as shown in FIG. 1. The game control down loads 910 all or part of the hand information, which may include: the amount of the game bets placed during the hand, the history of the game including the value and suit of each card dealt from the shoe 250 and the value and suit of each card to each player position, and any alarms detected such as a card without a proper deck identity, etc. Upon completion of the download, information may be delivered from the central control CC 20 to the game control. For example, the new progressive jackpot value 920 would be received and the game control would then update and display in stage 930 the new progressive jackpot value. This would indicate the start of a new hand 940.

Likewise, from the viewpoint of the central control 20, it is connected 1000 to a given gaming table 2000 and it uploads the information in stage 1010 that corresponds to the information downloaded in stage 910 of FIG. 9. The central control 20 determines in stage 1020 if there are any winners during the last hand. If there are no winners, stage 1030 is entered, and based on the value of the progressive contributions, if any, from all of the tables, the central control 20 determines a new progressive jackpot value and downloads it over the communication link L in stage 1040. Other information could also be downloaded including the identity of the winner and table if a progressive jackpot win occurred elsewhere in the system. New combination codes (i.e., winning card sequences) for progressive jackpot wins can also be downloaded. If a winner is detected in stage 1020, then stage 1050 is entered and the necessary winner information is obtained and documented. The jackpot must now be adjusted downwardly to reflect the win in stage 1030. After downloading information to the game control, the central control 20 in stage 1060 may disconnect.

Figure 11:
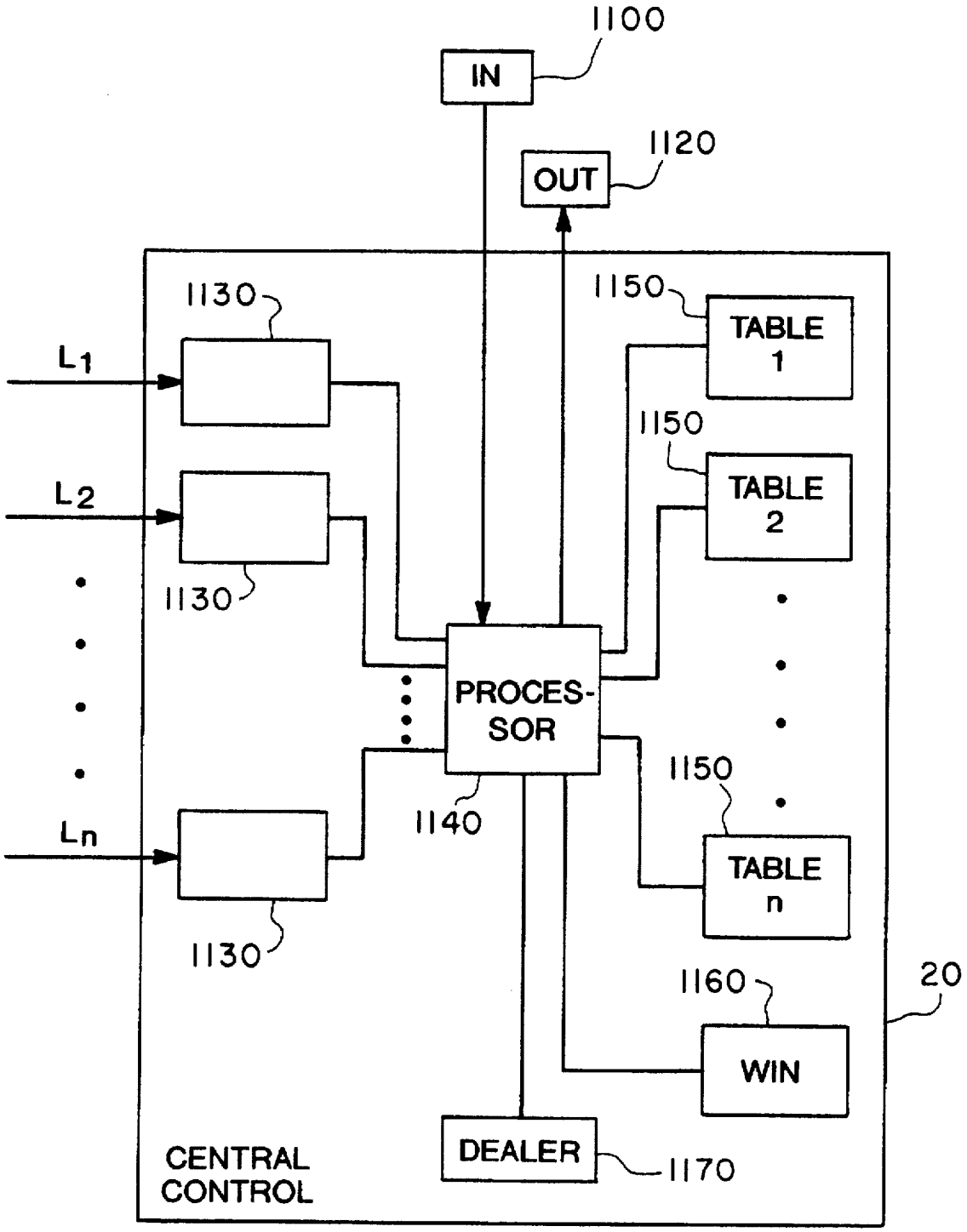
FIG. 11 is a block diagram setting forth the components of the central control, FIG. 12 sets forth the addition of an optical reader to the shoe of an automatic shuffler set forth in U.S. Pat. No. 5,356,154.

In FIG. 11, the details of the central control 20 are set forth. The central control 20 is a conventional microprocessor system with conventionally available inputs 1100 such as a keyboard, a mouse, etc., and conventional outputs 1120 such as a printer. Any conventional configuration for a microprocessor system can be utilized for the central control 20. The central control 20 is interconnected over the communication links L1 through Ln as shown in FIG. 1. Each link L1 to Ln engages a communication port 1130 such as a modem. The port 1130 is connected to a central processor 1140. The processor 1140 is interconnected to memories 1150 and 1160. The history of each hand for each table is stored in memory 1150, including player positions being played, the actual contents of each hand dealt and each hand existing at each position, the game bets, etc. The memory 1160 sets forth a complete record of players who have won the progressive jackpots.

It is to be understood that the memories 1150 and 1160 can be of any suitable configuration and arrangement and may be a relational data base. For example, information on each dealer can be keyed in at each game control GC so that dealer information, time of the game, or any other suitable management information can be delivered over the communication link L into the memory 1150. Hence, should a dealer go from table to table and the memory 1150 is, for example, relational, the processor 1140 can quickly ascertain a dealer history and store it, for example, in a separate dealer memory 1170 if desired. It is to be understood that each gaming control GC also has an input/output circuit like circuits 1100 and 1120 that is not shown in the drawing.

9. Integrated Shuffler/Shoe

In FIGS. 12 through 14 modifications to the conventional, prior art automatic shuffler of U.S. Pat. No. 5,356,154 are set forth.

In FIG. 12, the shoe 250 is integrated into the shuffler 240 and has a dispensing region 1210 with opposing ridges 1220A and 1220B on either side thereof. A card 1230A is moved into position 1230B in the dispenser 1210. In the preferred operation, the dealer takes his finger and places it in area 1202 and pulls card 1230A in the direction of arrow 1232. This moves the card into the position 1230B and places the card 1230B over a formed opening 1240. Centrally disposed in this opening is a lens 1250. Integrating the shoe 250 and the shuffler 240 into one unit enhances the security of the system, since the transfer of the cards to the shoe 250 cannot be tampered with.

This is better shown in FIG. 13 wherein the shoe 250 is mounted to the gaming table 200. The lens 1250 is positioned through the gaming table 200 to capture an image from the face of the card 1230B as it is being dealt out of the shoe 250 by the dealer. The lens 1250 is connected to a conventional video camera 1260 and delivers optical images, in digital form, over lines 252 to the game control GC as shown in FIG. 2. The camera 1260 and the lens 1250 can be mounted in any fashion in conventional housing 1270. The location of the lens 1250 is immaterial as long as an image is captured.

In this fashion, each card 1230 as it is pulled down into the dispenser 1210 of the shoe 250 has an optical image taken as the card 1230 slides by. The image is taken as soon as the card 1230 leaves the shuffler 240. This reduces the risk that a card could be removed from the deck before an optical image is taken. It is to be expressly understood that the lens 1250 and the camera 1260 could be a suitable code reader such as a bar code reader or infrared code reader. In which case, the formed opening 1240 and the reader would be suitably located to take a reading. It is also to be understood that such a code reader could be used in conjunction with the taking of the optical images. Cameras and readers are presently small in size and can be suitably arranged to obtain both images and code readings (i.e., for deck identity).

The game control GC obtains a separate image for each card 1230 since as the card 1230B is removed from the shoe 250, the lens 1250, in its field of view 1280, receives a background ambient light reading until the next card 1230A is moved into position 1230B. In this fashion, the game control GC not only takes an optical image (or reads a code), but a count of the cards is also taken.

The rear of the automatic card shuffler 240, set forth in U.S. Pat. No. 5,356,145, has a region which receives inserted cards after a hand is played. These cards, as taught in this patent, are stacked in an opening (labeled 5 in the '145 patent) and are shown as a stack (labeled 93 in the '145 patent) of cards for insertion. This is shown in FIG. 4 of the '145 patent. In the following discussion, the use of the letter "a" after the numeral indicates that the numeral has a corresponding reference in the '145 patent. Hence, 93*a* refers to numeral 93 in FIG. 4 of the '145 patent.

As shown in FIG. 14, a drive disk 37*a* is connected over a shaft to a drive motor 38*a*. The shaft 1400 as shown in FIG. 14 is operably connected to the drive motor 38*a* and the drive disk 37*a* and is connected between side walls 30*a* of the shuffler 240. As taught by the '145 patent, the bottom card 1410 in the stack of cards 93*a* is selectively picked by the drive disk 37*a* and moved out of the stack 93*a* and delivered internally to the shuffler 240 as taught in the '145 patent to stack 16*a* as shown in FIG. 15.

This shuffler 240 is modified, as shown in FIG. 14, to provide a lens 1420 having a field of view 1415 near the drive disk 37*a* to read part of the face of the card 1410 either including the code 310 or obtaining an optical image from a portion of the face of the card 1410. The lens 1420 is connected to a camera 1430. The camera 1430 is in a housing 1440 that is connected to the bottom of the gaming table 200 with the lens 1420 projecting upwardly through the gaming table 200 into the automatic shuffler 240. In this fashion, each card 1410 as it is delivered from the stack 93*a* has an optical image taken or a reader reading the code 310. This information is delivered over lines 248 to the game control GC.

As illustrated in FIG. 15, which is a side illustration corresponding to that of FIG. 4 of the '145 patent, the field of view 1415 of the lens 1420 may be slightly offset to capture a region 1450. This region 1450 is partially off of the card 1410A.

To capture an image, a conventional light 1460 may be provided in the interior of the shuffler 240 to provide illumination of the face of the card 1410A. Some conventional video cameras 1430 are sensitive enough to obtain an image without the provision of a light 1460.

The drive disk 37*a* turning in the direction of the arrow 1470 causes the card 1410A to move toward an internal stack 16A as illustrated by card 1410B. This is conventionally taught by the '145 patent. Between each card transfer from stack 93*a* to stack 16*a* them will be a short period of time in region 1450 in the field of view 1415 of the lens 1420 that provides a background ambient light signal so as to provide a separation or count of the cards.

It is to be expressly understood that any of a number of equivalent design approaches could be utilized to provide the timing necessary to capture an image of each individual card 1410A in the stack 93A. It is also to be expressly understood that the optical image taken by the cameras 1430 under the shuffler 240 of the present invention may be limited to the region existing in the upper-left and lower-right corners of a card. For example and as illustrated in FIG. 3, a 3 of Diamonds in such corners contains the value=the number 3 and the suit=the diamond shape in region 320. The count can also be determined by counting the different optical images obtained without providing a background ambient light reading such as provided by area 1450.

The optional embodiment shown in FIGS. 12 through 15 provides a secure automatic card shuffler 240 and a secure hand. In the internal environment of the shuffler 240, the game control GC by sensing the images coming from the shoe 250 provides an accurate count and card identity verification Likewise, all cards dealt in a hand from the shoe 250 as the hand is played by the dealer and each of the players must come back into the shuffler 240 to be counted and to be properly identified. In each of the four Examples of hands set forth above, the integrated automatic shuffler 240/shoe 250 of the present invention provides an optical image of each card dealt to the game control GC, which stores (stage 640 in FIG. 6) this in memory and/or delivers it to the central control 20 (stages 910 and 1010 in FIGS. 9 and 10). Likewise, after a hand is played, each card upon insertion is read and the image is delivered to the game control GC, and the identity and count is verified (stages 695 and 697 in FIG. 6) and/or delivered to the central control 200. This prevents any cards from being added or subtracted from the hand. Any added or subtracted cards will be immediately detected and an alarm 698 or 696 raised. However, if a marked card of the same suit and value from another deck is substituted this will not be detected unless the card identity code is provided as discussed above. Although this is an optional feature of the secure live card progressive jackpot system of the present invention, it is an important feature to provide a secure game.

Figure 16:
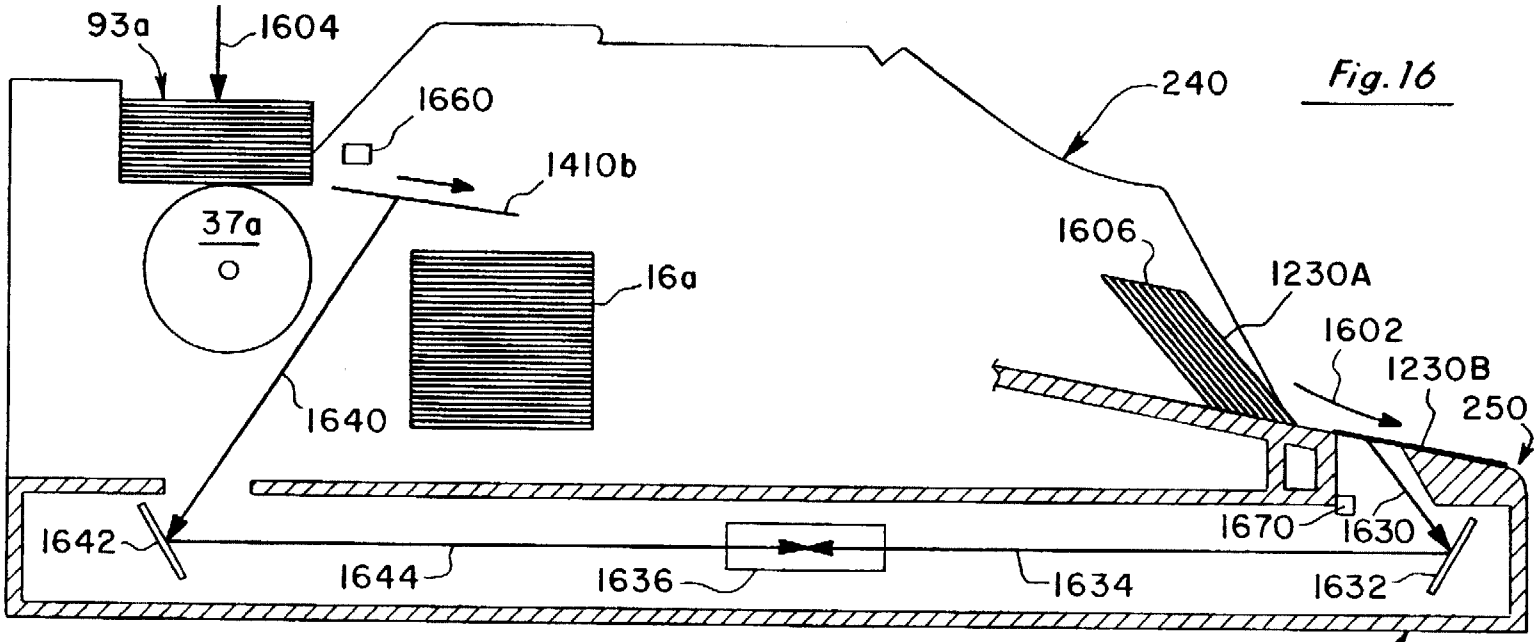
FIG. 16 is an illustration setting forth the addition of a single reader to the automatic shuffler of U.S. Pat. No. 5,356,154.
Figure 17:
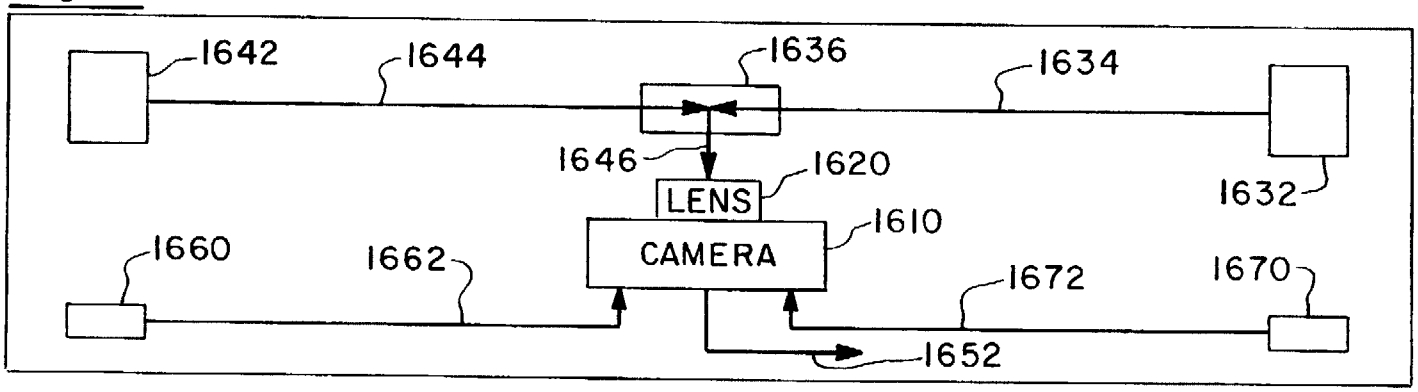
FIG. 17 is a top view illustration of the addition of FIG. 16.

In FIGS. 16 and 17 is set forth another embodiment of the secure shuffler 240 of the present invention. Again, this shuffler 240 is based on that set forth in U.S. Pat. No. 5,356,145. The shuffler 240 is mounted on a base 1600 in which is contained a camera 1610 with a lens 1620. Hence, this embodiment is self-contained and is not mounted to the table.

In this embodiment, a single camera 1610 is used to record optical images of the cards dealt (as indicated by arrow 1602) and cards inserted (as indicated by arrow 1604). The inserted cards are placed in stack 93*a* and the cards dealt are dealt from stack 1230.

Hence, in FIG. 16, a card 1230B is placed in the modified shoe 250 and an image is delivered as shown by arrow 1630 into a mirror 1632 and is reflected 1634 into a central mirror 1636. Likewise, when card 1410B in stack 93*a* is delivered into stack 16*a* by drive disk 37*a*, an image 1640 is delivered into a mirror 1642 and is reflected 1644 into the central mirror 1636. The lens 1620 receives the reflected signals 1646 from the central mirror 1636 and delivers these optical images over lines 252 to the game control GC. It is to be expressly understood that the images 1630 and 1640 can be obtained from a number of regions internal to the shuffler 240 and that mirrors other than mirrors 1632 and 1636, can be used to reflect images into the lens 1620.

Sensors 1660 and 1670 can be provided to sense the presence of a card being optically imaged. Hence, sensor 1660 senses (such as optically) the delivery of a card 1410B and delivers a signal over line 1662 to the camera 1610, thereby indicating to the camera 1610 the image source that it is recording. Hence, when signals are detected by the sensor 1660 and delivered over line 1662 to the camera 1610, the camera 1610 is recording optical images of inserted cards 93*a*. When the sensor 1670 detects the presence of a card 1230B to be dealt, a signal is generated over line 1672 to the camera 1610 thereby indicating to the camera 1610 that optical images of cards to be dealt 1230A are being recorded by the camera 1610.

Hence, in this embodiment, a single camera system can be utilized through interaction with mirrors to record the optical image.

10. Method of Operation

In one method of operation, the present invention provides a novel method of incorporating a progressive jackpot in a live card game with a dealer and a player without changing normal game betting. The player places only a game bet (ante or wager) to participate both in the live card game and in the progressive jackpot. A progressive contribution to the progressive jackpot may or may not be made based on that game bet during the play of the hand. The cards are dealt to the dealer and to the player to form playing hands. When a predetermined game event occurs (such as when a dealer goes bust in blackjack), a predetermined percentage of the game bet (i.e., initially made or the total game bet placed) is contributed to the progressive jackpot. This contribution, however, does not affect the value of the game bet. When a predetermined sequence of cards occurs in the hand of the player, the progressive jackpot is then awarded to the player whether or not a progressive contribution is made during that hand. It is to be understood that the value of the game bet remains conventional throughout the play of the game and, therefore, the progressive jackpot element incorporated into the live card game is essentially transparent to the player. The player knows that when the predetermined event occurs during the play of the game that a percentage of the game bet is added to the progressive jackpot, but the player also knows that the value of his game bet remains the same during the play of the game. The play of the hand continues and (1) if the player has a winning hand of cards according to the rules of the live card game, then the player is paid an amount based on the wager, or (2) if the player has a losing hand of cards according to the rules of the live card game, then the wager is taken by the house. For purposes of definition a winning hand of cards would include where the player "pushes" and receives the wager back.

More specifically, under the method of the present invention, the progressive jackpot element is provided in a live card game played on a gaming table between a dealer and a player. The player places a game wager in the bet region, of the gaming table to play both the live card game and the progressive jackpot. When the player places the game wager in the bet region the value of the game wager (and, in another embodiment, any increases during the play) is automatically detected and recorded. Both the dealer and the player see the ante bet and, in a conventional and traditional manner, know the value of the game bet being placed. At the same time, the value of the game bet is automatically sensed and recorded. The dealer deals hands of cards to the dealer and to the player. The hands of cards are then played by the dealer and the player according to the rules of the live card game. As the dealing and playing of the hands occur, the identity of each card is automatically sensed and recorded. When the system determines the occurrence of the predetermined game event, a percentage of the game bet is automatically added to the progressive jackpot while preserving the value of the ante during the play of the live card game. When the winning sequence of cards occurs in the hand of the qualifying player, the progressive jackpot is awarded to the player.

The present invention has been illustrated for the live card game of blackjack. However, it is to be expressly understood that any casino live card game (such as the many varieties of poker games) may be suitably adopted herein in a single game wager progressive jackpot environment. The invention has been described with reference to the preferred embodiment. Modifications and alterations will occur to others upon a reading and understanding of this specification. This specification is intended to include all such modifications and alterations insofar as they come within the scope of the appended claims or the equivalents thereof.

I claim:

1. A method of incorporating a progressive jackpot in a live card game with a dealer and a player comprising the steps of:

a) the player placing an ante having a value to participate in both the live card game and the progressive jackpot, b) dealing hands of cards to the dealer and to the player, c) adding an amount of the ante to the progressive jackpot when a predetermined game event occurs so as to preserve the value of the ante during the live card game, d) awarding the progressive jackpot to the player when a predetermined winning sequence of cards occurs in the hand of the player, e) paying the player an amount based on the value of the ante when the player has a winning hand of cards in the live card game, and f) taking the ante when the player has a losing hand of cards in the live card game.

2. The method of claim 1 wherein said amount is a percentage of the ante.

3. The method of claim 1 wherein said amount is a fixed amount of the ante.

4. The method of claim 1 wherein said live card game is blackjack and wherein said predetermined game event is the dealer going bust.

5. The method of claim 1 wherein said live card game is blackjack and wherein said predetermined game event is the dealer having twenty-one.

6. The method of claim 1 wherein said predetermined game event is the start of the game.

7. The method of claim 1 wherein said predetermined game event is the placing of a minimum ante.

8. The method of claim 1 wherein the step of adding is determined by a computer.

9. A method of providing a progressive jackpot in a live card game played on a gaming table between a dealer and a player, said gaming table having a computer controlled system, said method comprising the steps of:

a) the player placing an ante on the ante bet region of the gaming table to participate in both the live card game, and the progressive jackpot b) automatically sensing the value of the ante placed by the player in the ante bet region with the computer controlled system, c) dealing hands of cards to the dealer and to the player, d) automatically identifying each card in each of the hands during dealing with the computer controlled system, e) playing the hands of cards in the live card game, f) automatically adding a predetermined amount of the value of the ante to the progressive jackpot only when a predetermined game event occurs with the computer controlled system in response to the step of identification while preserving the value of the ante during the play of the live card game, and g) automatically awarding the progressive jackpot to the player when a winning sequence of cards occurs in the hand of the player with the computer controlled system in response to the step of identification.

10. The method of claim 9 wherein said amount is a percentage of the ante.

11. The method of claim 9 wherein said amount is a fixed amount of the ante.

12. The method of claim 9 wherein said live card game is blackjack and wherein said predetermined game event is at least one of the following:

(a) the dealer going bust, (b) the dealer having twenty-one, (c) the start of the game, (d) the placing of a minimum ante.

13. The method of claim 9 further comprising the steps of:

the player placing a proposition bet on the proposition bet region of the gaming table, automatically sensing the value of the proposition bet placed by the player in the proposition bet region with the computer Controlled system, automatically awarding a proposition jackpot to the player when a proposition event occurs during the playing hands of cards in the live card game with the computer controlled system.

14. The method of claim 13 wherein the live card game is blackjack and the proposition event is the dealer receiving a blackjack.

15. The method of claim 13 wherein said proposition jackpot is a multiple of said proposition award.

16. The method of claim 13 further comprising the steps of automatically adding a predetermined amount of the value of the proposition bet to the progressive jackpot when a proposition bet is sensed with the computer controlled system.

17. A system of providing a progressive jackpot in a live card game played on a gaming table between a dealer and a player, said gaming table having an ante bet region, a dealer card region, and a player card region, said live card game having hands of cards, said system comprising the steps of:

a) a sensor detecting the value of an ante placed in the ante bet region by the player, b) a reader identifying each card during dealing of the hands of the player and the dealer during the live card game, c) a computer having a memory, said memory having stored therein (a) a predetermined game event and (b) a winning sequence of cards, said computer connected to the sensor, to the reader, and to the progressive jackpot for adding a predetermined amount of the value of the ante to the progressive jackpot when the predetermined game event occurs while preserving the value of the ante during the play of the live card game, said computer awarding the progressive jackpot to the player when said computer detects the winning sequence of cards in the hand of the player.

18. The system of claim 17 in which said sensor is located under said ante bet region of said gaming table.

19. The system of claim 17 in which said reader comprises:

a shoe, and a camera coupled to said shoe for capturing an image of each card as it is dealt from said shoe.

20. The system of claim 17 wherein said predetermined game event occurs based on rules governing the play of the live card game.

21. The system of claim 18 wherein said live card game is blackjack and said predetermined game event is at least one of the following:

a) dealer going bust, b) dealer getting twenty-one, c) player getting twenty-one, and d) player placing an ante in a minimum amount.

22. A method of incorporating a progressive jackpot in a live card game with a dealer and a player comprising the steps of:

a) the player placing an ante to participate in both the live card game and the progressive jackpot, b) determining the value of the ante, c) calculating a predetermined contribution of the ante, d) dealing a hand of cards to the dealer and to the player, e) determining whether a predetermined game event occurs during the play of the live card game, f) when a predetermined game event occurs, adding the progressive jackpot contribution to the progressive jackpot, g) maintaining the value of the ante without subtractive effect from the addition to the progressive jackpot, h) determining the sequence of cards in the hand of the player, i) if a winning sequence of cards occurs in the hand of the player, awarding the progressive jackpot to the player, j) paying the player an amount based upon the value of the ante when the player has a winning hand of cards in the live card game, and k) taking the ante when the player has a losing hand of cards in the live card game.

23. A method of playing live card games and providing a player with an opportunity to win a large jackpot in a computer controlled system when said player holds a hand of predetermined cards, the method comprising the steps of:

a) playing a multiplicity of conventional live card games on a plurality of separate live card game tables, b) the player placing a wager on a bet region on the game table to participate in both the live card game and the progressive jackpot, c) at the bet regions on the top surfaces of the game tables, sensing the value of the ante wagers with the computer controlled system, d) accumulating money available for the large jackpot as a function of each ante wager placed on the tables with the computer controlled system, e) from the accumulated jackpot money determining the size of the jackpot with the computer controlled system, f) playing the card game on each table with a plurality of complete decks of cards, g) selecting said predetermined hand comprising a hand of cards, h) awarding the large jackpot to a player who holds said predetermined hand of cards.

24. The method of claim 23 wherein the live card game is blackjack.

25. The method of claim 23 including the step of locating the plurality of live card tables in a single gaming establishment.

26. The method of claim 23 further including the step of locating the plurality of tables in a plurality of geographically separate gaming establishments.

27. The method of claims 1, 9, 17, or 23 wherein said live card game is blackjack and the predetermined winning sequence of cards is the player being dealt two blackjacks in the same hand.

28. The method of claims 1, 9, 17, or 23 wherein said live card game is blackjack and the predetermined winning sequence of cards is the player being dealt three blackjacks in the same hand.

29. The method of claims 1, 9, 17, or 23 wherein said live card game is blackjack and the predetermined winning sequence of cards is the player being dealt four blackjacks in the same hand.

30. The method of claims 1, 9, 17, or 23 wherein said live card game is blackjack and the predetermined winning sequence of cards is the player being dealt two aces and one blackjack in the same hand.

31. The method of claims 1, 9, 17, or 23 wherein said live card game is blackjack and the predetermined winning sequence of cards is the player being dealt three aces and one blackjack in the same hand.

32. The method of claims 1, 9, 17, or 23 wherein said live card game is blackjack and the predetermined winning sequence of cards is the player being dealt three aces and two blackjacks in the same hand.

33. The method of claims 1, 9, 17, or 23 wherein said live card game is blackjack and the predetermined winning sequence of cards is the player being dealt four aces and one blackjack in the same hand.

34. The method of claims 1, 9, 17, or 23 wherein said live card game is blackjack and the predetermined winning sequence of cards is the player being dealt four aces and two blackjacks in the same hand.

35. The method of claims 1, 9, 17, or 23 wherein said live card game is blackjack and the predetermined winning sequence of cards is the player being dealt four aces and three blackjacks in the same hand.

36. A method of providing a jackpot award in a live card game played on a gaming table between a dealer and a player, side gaming table having a computer controlled system, said method comprising the steps of:

a) the player placing an ante on the ante bet region of the gaming table to participate in both the live card game, and the progressive jackpot b) automatically sensing the value of the ante placed by the player in the ante bet region with the computer controlled system, c) dealing hands of cards to the dealer and to the player, d) automatically identifying each card in each of the hands during dealing with the computer controlled system, e) playing the hands of cards in the live card game, f) awarding the jackpot award to the player when a winning sequence of cards occurs in the hand of the player in response to the step of identification, g) paying the player an amount based upon the value of the ante when the player has a winning hand of cards in the live card game, h) taking the ante when the player has a losing hand of cards in the live card game.

37. The method of claim 36 further comprising the steps of:

a) providing a progressive jackpot and, b) automatically awarding the jackpot award to the player when a winning sequence of cards occurs in the hand of the player in response to the step of identification.

* * * * *